US011135489B2

(12) United States Patent
Peterson et al.

(10) Patent No.: US 11,135,489 B2
(45) Date of Patent: Oct. 5, 2021

(54) THREE-DIMENSIONAL GOLF BALL MARKER

(71) Applicant: On Point Ball Marker LLC, Basalt, CO (US)

(72) Inventors: Briston Peterson, Basalt, CO (US); James Joseph Verna, Basalt, CO (US)

(73) Assignee: On Point Ball Marker, LLC, Basalt, CO (US)

( * ) Notice: Subject to any disclaimer, the term of this patent is extended or adjusted under 35 U.S.C. 154(b) by 0 days.

(21) Appl. No.: 16/358,265

(22) Filed: Mar. 19, 2019

(65) Prior Publication Data

US 2019/0282871 A1 Sep. 19, 2019

Related U.S. Application Data

(60) Provisional application No. 62/645,111, filed on Mar. 19, 2018.

(51) Int. Cl.
*A63B 57/30* (2015.01)
*A63B 57/20* (2015.01)

(52) U.S. Cl.
CPC ..... *A63B 57/353* (2015.10); *A63B 57/207* (2015.10)

(58) Field of Classification Search
CPC ..... A63B 57/353; A63B 57/207; A63B 57/35; A63B 2220/20; A63B 2220/13;
(Continued)

(56) References Cited

U.S. PATENT DOCUMENTS 1,541,504 A * 6/1925 Hunter ..... G09F 23/14 40/538
1,558,078 A * 10/1925 Darby ..... A63B 57/00 473/405

(Continued)

FOREIGN PATENT DOCUMENTS

CA 2920230 A1 * 2/2015 ..... A63B 57/207
KR 20080005443 U * 11/2008
KR 20090058485 A * 6/2009 ..... A63B 69/3688

OTHER PUBLICATIONS

U.S. Appl. No. 29/672,877, Notice of Allowance dated Mar. 4, 2020, 11 pp.

(Continued)

*Primary Examiner* — Steven B Wong
(74) *Attorney, Agent, or Firm* — Lathrop GPM LLP

(57) ABSTRACT

A three-dimensional golf ball marker for marking a position of a golf ball on a putting green includes a housing with a bottom surface and a spherical cap including a texture selected from the group consisting of golf ball like dimples, smooth, grooved, ridged, rubbery, and polished. The spherical outer surface of the housing may rotate and includes an alignment mark formed around at least part of a diameter of the housing. The three-dimensional golf ball marker may include a removable marking disc, with an alignment mark formed on at least one side, which is retained adjacent the bottom surface of the housing by a magnet or retained within a slot. The three-dimensional golf ball marker may include a wireless location device that transmits a wireless signal to allow a tracking device to determine a location of the three-dimensional golf ball marker and to generate information of the golfer.

15 Claims, 19 Drawing Sheets

(58) Field of Classification Search
CPC ..... A63B 2220/14; A63B 2225/54; A63B 2220/12; A63B 2024/0056; A63B 2024/0053; A63B 69/3676; A63B 2071/0694; A63B 57/20; A63B 57/30; A63B 57/50; A63B 57/0037; A63B 53/0487
See application file for complete search history.

(56) References Cited

U.S. PATENT DOCUMENTS 1,789,525 A 1/1931 Hoff
2,388,463 A * 11/1945 Benecke ..... A63B 15/00 473/234
3,099,450 A * 7/1963 Randall ..... A63H 33/18 473/588
3,540,735 A * 11/1970 Miller ..... A63B 69/3655 473/267
D220,769 S * 5/1971 LaHue ..... D21/709
3,700,244 A * 10/1972 Liotta ..... A63B 69/3685 473/240
3,759,527 A * 9/1973 Witherspoon ..... A63B 53/04 473/306
4,017,082 A * 4/1977 Channing ..... A63B 57/207 473/285
4,128,238 A * 12/1978 Newcomb ..... A63B 37/14 273/DIG. 20
4,858,925 A * 8/1989 DeStefano, Jr. ..... A63B 57/207 473/285
5,305,999 A * 4/1994 Tate ..... A63B 57/207 473/406
5,417,426 A * 5/1995 Bayer ..... A63B 47/02 473/285
D361,558 S * 8/1995 Siano, Jr. ..... D14/403
5,437,446 A * 8/1995 Youngkin ..... A63B 69/3676 473/409
5,476,258 A * 12/1995 Frisone ..... A63B 57/353 473/404
5,478,612 A * 12/1995 Hack ..... B44C 5/00 428/11
D373,115 S * 8/1996 Logan ..... D13/183
D378,516 S * 3/1997 Smith ..... D14/403
5,743,180 A 4/1998 Arnke
5,795,248 A * 8/1998 Giglio ..... A63B 57/203 473/406
D400,440 S * 11/1998 Tucker ..... D9/451
6,077,174 A 6/2000 Noritake
6,095,933 A * 8/2000 Smith ..... G01C 9/36 473/404
6,125,747 A 10/2000 Elliott
6,383,086 B1 * 5/2002 Flood ..... A63B 69/3685 473/219
D503,085 S * 3/2005 McGrath, Jr. ..... D8/395
D526,239 S * 8/2006 Porter ..... D11/133
D527,066 S * 8/2006 Greiner ..... D21/790
D554,725 S 11/2007 Park
7,549,930 B2 * 6/2009 Rice ..... A63B 43/002 473/157
D605,719 S * 12/2009 Bernal-Silva ..... D21/791
D607,527 S * 1/2010 Bernal-Silva ..... D21/791
7,654,920 B2 2/2010 Perry
D616,953 S 6/2010 Shinki
D622,799 S 8/2010 Cameron
7,819,762 B2 * 10/2010 Bernal-Silva ..... A63B 43/002 473/280
D630,284 S * 1/2011 Desrosiers ..... D21/794
D632,351 S * 2/2011 Scott ..... D21/794
7,922,605 B2 * 4/2011 Lim ..... A63B 57/353 473/406
8,016,698 B2 9/2011 Cameron
D654,539 S * 2/2012 Hobbs ..... D19/95
D661,761 S 6/2012 Cameron
8,216,091 B2 * 7/2012 Neal ..... A63B 43/002 473/422
8,313,393 B1 * 11/2012 Toxen ..... A63B 57/207 473/324
D704,291 S 5/2014 Snyder
D721,152 S 1/2015 Kokoska
D736,334 S 8/2015 Perry
D837,325 S * 1/2019 Dardenne ..... D21/793
D849,508 S * 5/2019 Shorr ..... D8/349
D872,817 S * 1/2020 Peterson ..... D21/794
D892,248 S 8/2020 Beard
D914,821 S 3/2021 Leposky et al.
2010/0222160 A1 * 9/2010 Williams ..... A63B 69/3676 473/405
2011/0053711 A1 * 3/2011 Trafford ..... A63B 69/3676 473/406
2012/0210615 A1 * 8/2012 Coney ..... G09F 7/04 40/324
2015/0065271 A1 * 3/2015 Peterson ..... A63B 57/207 473/406
2017/0087436 A1 * 3/2017 Peterson ..... G09G 3/00
2017/0164152 A1 * 6/2017 Rosenthal ..... H04W 4/023
2018/0345101 A1 * 12/2018 Youn ..... A63B 1/00

OTHER PUBLICATIONS

U.S. Appl. No. 29/720,443, Non-Final Office action dated May 11, 2021, 9 pages.

* cited by examiner

THREE-DIMENSIONAL GOLF BALL MARKER

RELATED APPLICATIONS

This application claims priority to U.S. Provisional Patent Application Ser. No. 62/645,111, filed Mar. 19, 2018, and incorporated in its entirety herein by reference.

BACKGROUND

A position of a golf ball on a putting green is traditional marked with a flat disc or coin. The golfer may mark and lift the golf ball to clean it and/or when it is another golfer's turn to play. The golfer typically waits until it is their turn to play before attempting to determine a line for putting the ball into the hole, since the visual appearance of the ball is typically used as part of the determination process by the golfer. Accordingly, play on the green is substantially serial in nature; each golfer awaiting their turn to play before determining the line for the golf ball.

SUMMARY

One aspect of the embodiments disclosed herein includes the realization that in the game of golf, each golfer marks and lifts their ball, and then waits until their turn before replacing their ball and determining a line for the ball to follow into the hole, since positioning the ball on the putting green is typically a part of the visual process for determining the line. Advantageously, the golf ball marker of the present disclosure visually resembles a golf ball and therefore allows the golfer to visually determine the line for the ball without requiring the ball to be replaced. A further advantage of the golf ball marker disclosed in the embodiments hereof is that it includes an alignment mark that allows the golfer to visualize a possible line for the ball towards the hole. Thus, the golfer may prepare to putt before they replace their ball, saving time during play on the green.

In one embodiment, a three-dimensional golf ball marker marks a position of a golf ball on a putting green. The three-dimensional golf ball marker includes a housing with spherical cap shape with a bottom surface formed by a cap plane, and an alignment mark formed on a spherical outer surface of the housing.

In another embodiment, a system enhances a golf spectator experience, and includes a three-dimensional golf ball marker, a tracking apparatus, and a spectator server. The three-dimensional golf ball marker is configured with a wireless location device, and to be carried and used for marking a position of a golf ball on a putting green by a golfer in a golf game. The tracking apparatus periodically receives a wireless signal from the wireless location device and determines a location of the three-dimensional golf ball marker. The spectator server periodically receives the location from the tracking apparatus, generates information of the golfer from the location, and sends the information to a spectator.

DETAILED DESCRIPTION OF THE EMBODIMENTS

During play, a golfer may need to lift a golf ball from a putting green, for example to clean it, or when it is a distraction to, or in the way of, another golfer. Conventionally, a coin like flat disc is positioned behind the golf ball to mark the position before the golf ball is lifted. When it is the golfer's turn to play, the golfer places the golf ball in front of the disc, removes the disc, and "reads" the green to determine a line and strength for striking the golf ball, hopefully, into the hole (or cup). The flat disc is not visually representative of a golf ball and accordingly the golfer typically waits until the golf ball is replaced on the green before attempting to read the green to determine a line and strength for the putt. Often, when placing the golf ball on the green, the golfer turns the golf ball to align a mark on the golf ball with an intended direction of travel for the golf ball. Then, when preparing to strike the golf ball with the putter, the golfer may use the mark to help align their putter and stroke.

The United States Golf Association (USGA) based in Far Hills, N.J., the Royal and Ancient Golf Club of St Andrews, Scotland, and the Professional Golfers' Association (PGA), define the size of a golf ball, hereinafter referred to as a regulation golf ball, as being not less than 1.680 inches or 42.67 mm in diameter.

In the rules of golf, as defined and followed by the United States Golf Association (USGA) based in Far Hills, N.J., the Royal and Ancient Golf Club of St Andrews, Scotland, and Professional Golfers' Association (PGA), Rule 20-1 states in part, "The position of a ball to be lifted should be marked by placing a ball-marker, a small coin or other similar object immediately behind the ball." The rule is interpreted as a recommendation, and there is no penalty for using a ball marker that is not a small coin or similar object. The selection of an acceptable ball marker is therefore more etiquette related than is controlled by the rules of golf.

Figure 1:
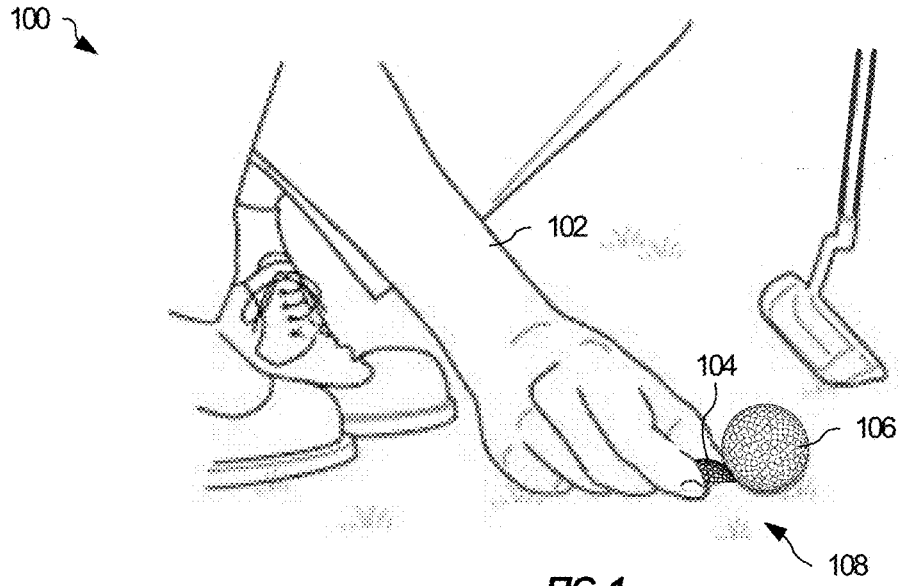
FIG. 1 is a perspective view showing a golfer using an example three-dimensional golf ball marker to mark a position of a golf ball on a putting green, in an embodiment.

FIG. 1 is a perspective view 100 showing a golfer 102 using an example three-dimensional golf ball marker 104 to mark a position of a regulation golf ball 106 on a putting green 108 before lifting the golf ball 106. As shown in FIG. 1, golfer 102 positions three-dimensional golf ball marker 104 behind golf ball 106, and may then lift the golf ball 106 from the putting green 108 without penalty. Unlike conventional coin like markers, three-dimensional golf ball marker 104, in certain embodiments, may have an appearance that more closely resembles the golf ball 106, and thus golfer 102 may read the putting green 108 with reference to three-dimensional golf ball marker 104. Accordingly, golfer 102 is more ready to take their stroke when replacing the golf ball 106 on the putting green 108 and removing three-dimensional golf ball marker 104, and the pace of play is improved.

Figure 2:
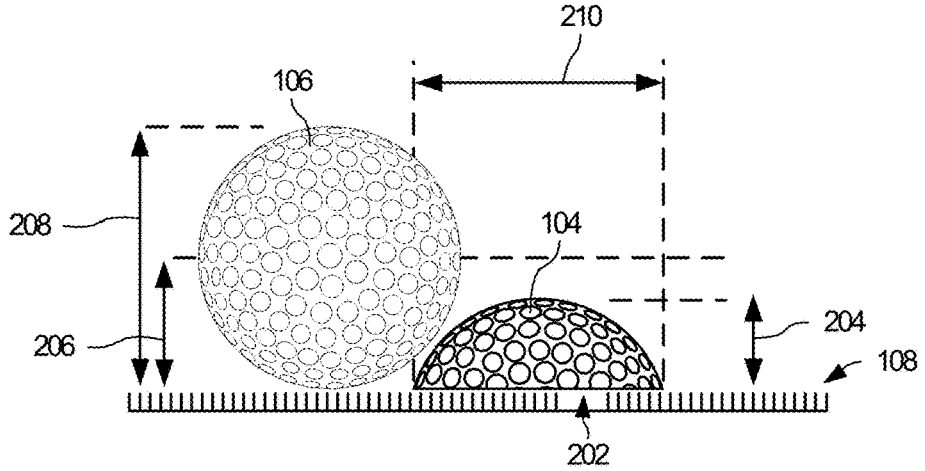
FIG. 2 is a side elevation showing the three-dimensional golf ball marker of FIG. 1 positioned behind the golf ball.

FIG. 2 is a side elevation showing three-dimensional golf ball marker 104 of FIG. 1 positioned behind golf ball 106 on putting green 108. Three-dimensional golf ball marker 104 is a spherical cap (e.g., a portion of a sphere cut off by an intersecting plane or a cap plane) that may have a spherical diameter that is between two inches and one inch, and be any portion of the corresponding sphere; where the intersecting plane is positioned between $1/10^{th}$ and $9/10^{th}$ of the diameter of the sphere. Accordingly, three-dimensional golf ball marker 104 has a flat surface 202 at the bottom, upon which it sits when placed on putting green 108. The size of three-dimensional golf ball marker 104 may be smaller than, equal to, or greater than the size of a regulation golf ball without departing from the scope hereof. In the embodiment shown in FIGS. 1 and 2, three-dimensional golf ball marker 104 has a height 204, when positioned on its flat surface 202, that is less than half (shown as height 206) of a height 208 of regulation golf ball 106, and has a diameter 210 that is greater than its height 208.

Figure 3:
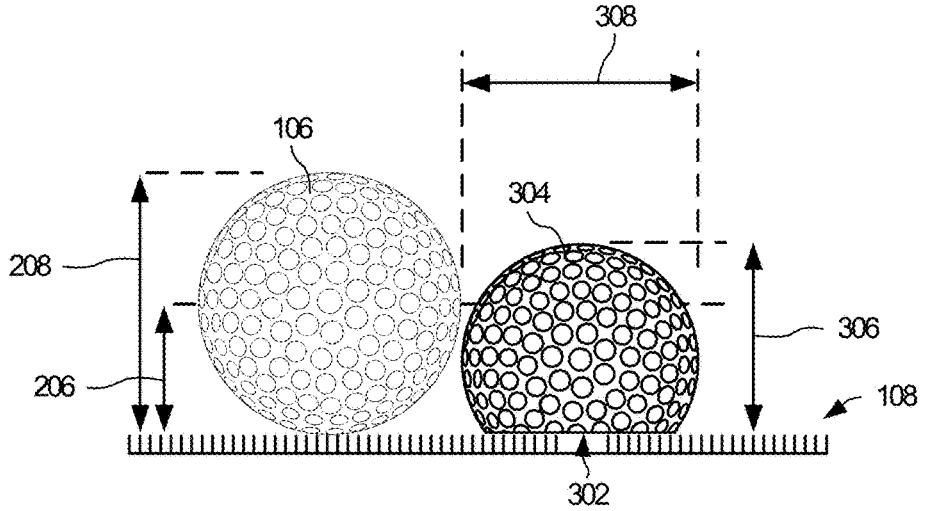
FIG. 3 is a side elevation showing another example three-dimensional golf ball marker positioned behind a golf ball, in an embodiment.

FIG. 3 is a side elevation showing an example three-dimensional golf ball marker 304 positioned behind golf ball 106 of FIG. 2, where three-dimensional golf ball marker 304 is a spherical cap with a height 306, when positioned on its flat surface 302, that is greater than half (shown as height 206) of height 208 of regulation golf ball 106. The size of three-dimensional golf ball marker 304 may be smaller than, equal to, or greater than the size of regulation golf ball 106 without departing from the scope hereof.

Figure 4:
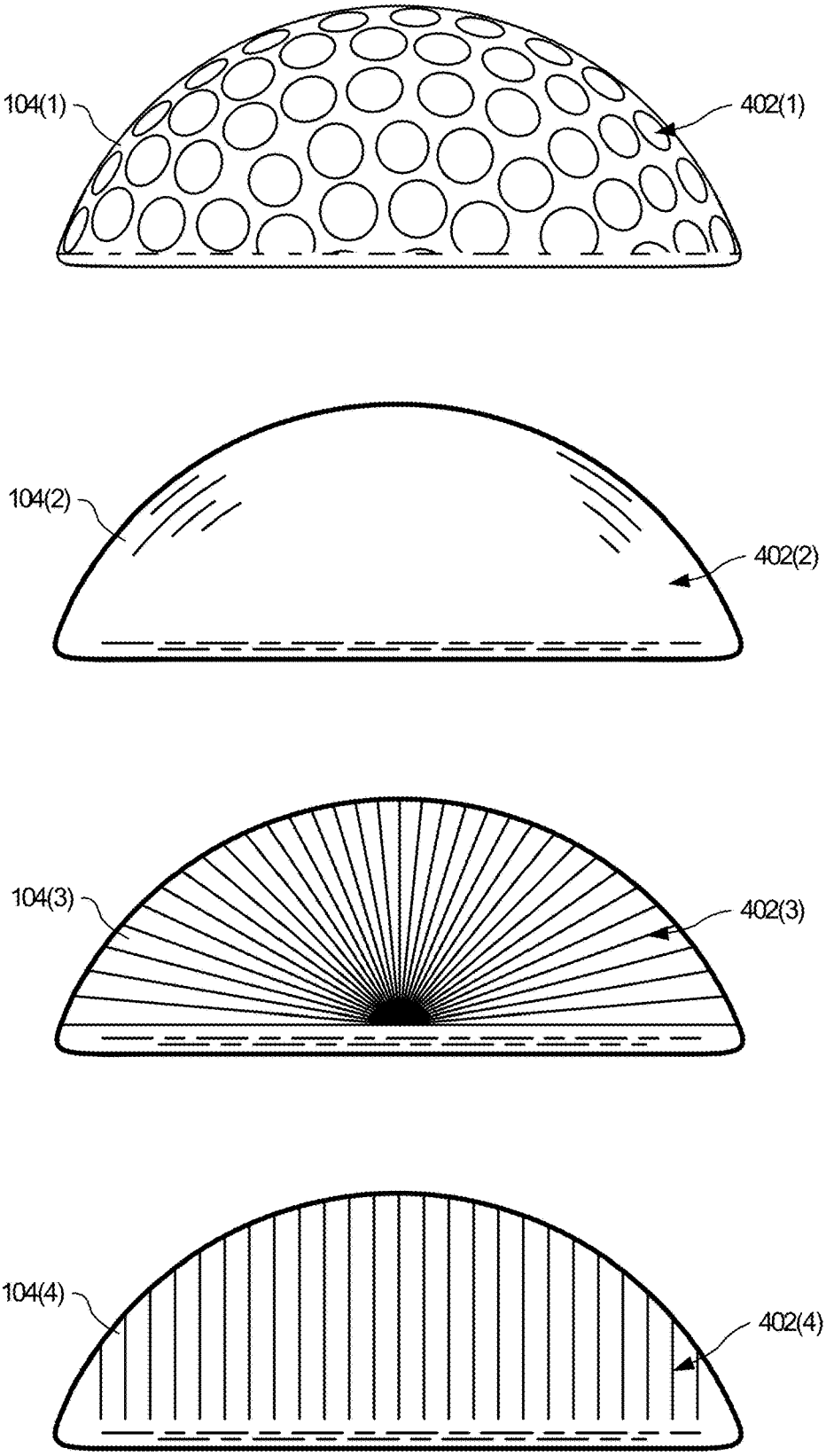
FIG. 4 shows four example three-dimensional golf ball markers, similarly shaped to the three-dimensional golf ball marker of FIGS. 1 and 2, but with different outer surface textures, in embodiments.

FIG. 4 shows four example three-dimensional golf ball markers 104(1)-(4), similarly shaped to three-dimensional golf ball marker 104 of FIGS. 1 and 2, but with different outer surface textures 402(1)-(4), respectively. For example, the texture of the outer surface may be formed during shaping of three-dimensional golf ball markers 104 or may be applied as a coating or outer surface material. The texture may be selected from the group including golf ball like dimples, smooth, grooved, ridged, rubbery, polished, and any combination thereof. The outer surface texture of three-dimensional golf ball marker 304 may be similar to outer surface textures 402(1)-(4). Three-dimensional golf ball marker 104(1), as also shown in FIGS. 1 and 3, has an outer surface texture 402(1) that is similar to the outer surface of golf ball 106, and is formed with golf ball like dimples for example. Three-dimensional golf ball marker 104(2) has a smooth and/or polished outer surface texture 402(2). Three-dimensional golf ball marker 104(3) has an outer surface texture 402(3) with longitudinal grooves or ridges. Three-dimensional golf ball marker 104(4) has an outer surface texture 402(4) formed with an alternate pattern of grooves or ridges. Three-dimensional golf ball markers 104 and 304 may have other outer surface textures without departing from the embodiments disclosed herein.

Figure 5:
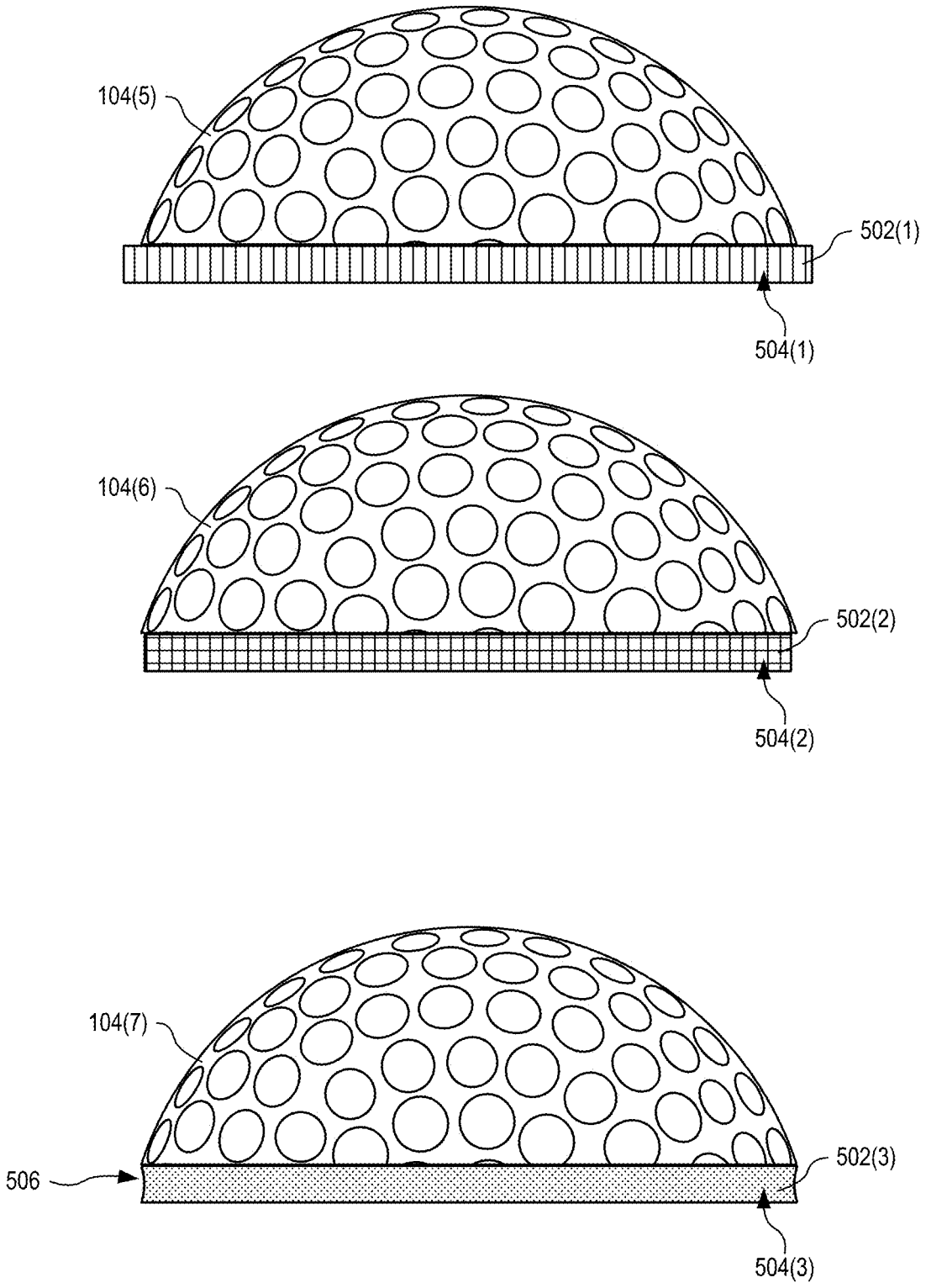
FIG. 5 shows three example three-dimensional golf ball markers, similarly shaped to the three-dimensional golf ball marker of FIGS. 1 and 2, but with bottom rims, in embodiments.

FIG. 5 shows three example three-dimensional golf ball markers 104(5)-(7), similarly shaped to three-dimensional golf ball marker 104 of FIGS. 1 and 2, but with bottom rims 502(1)-(3), respectively. Bottom rim 502(1) has a diameter that is slightly larger than the diameter (e.g., see diameter 210, FIG. 2) of three-dimensional golf ball marker 104(5). Bottom rim 502(2) has a diameter that is slightly smaller than the diameter of three-dimensional golf ball marker 104(6). Bottom rim 502(3) has a diameter that is equal to the diameter of three-dimensional golf ball marker 104(7). Bottom rim 502(3) also has a concave 506 surface. Outer surfaces 504(1)-(3) of bottom rims 502(1)-(3), respectively, may have different surface textures, finishes, and shapes without departing from the scope hereof. Outer surfaces 504(1)-(3) may be similar to outer surfaces textures 402(1)-(4) of FIG. 4, for example.

As described in detail below, three-dimensional golf ball markers 104 and 304 may also have other markings on the outer surfaces textures 402 (e.g., see FIGS. 32, 33 and 40). Three-dimensional golf ball markers 104 and 304 may be made from any type of material including plastic, metal (e.g., gold, silver, bronze, alloys, zinc, aluminum), glass, wood, rubber, polymer, carbon-fiber, any form of solid, and so on, and any combination thereof, and may have a coating of a different material to form outer surfaces texture 402 and/or outer surfaces 504.

Figure 6:
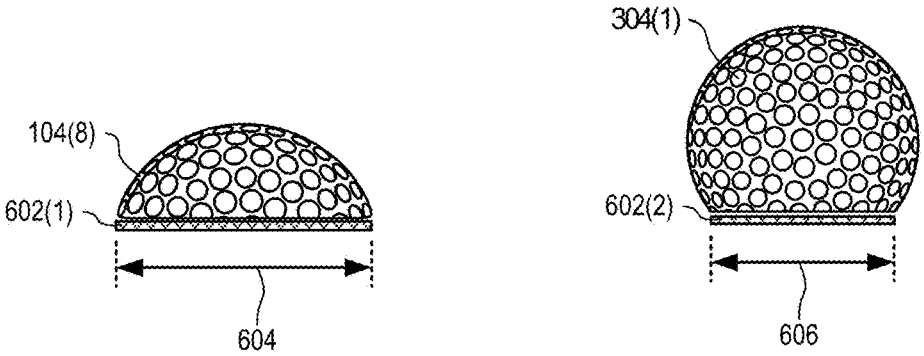
FIG. 6 shows a side elevation of a three-dimensional golf ball marker, similar to the three-dimensional golf ball marker of FIGS. 1 and 2, but configured with a removable marking disc and a side elevation of a three-dimensional golf ball marker, similar to three-dimensional golf ball marker 304 of FIG. 3, but configured with a removable marking disc, in embodiments.

In certain embodiments, three-dimensional golf ball markers 104 and/or 304 may include a removable marking disc. FIG. 6 shows a side elevation of a three-dimensional golf ball marker 104(8), similar to three-dimensional golf ball marker 104 of FIGS. 1 and 2, but configured with a removable marking disc 602(1) and a side elevation of a three-dimensional golf ball marker 304(1), similar to three-dimensional golf ball marker 304 of FIG. 3, but configured with a removable marking disc 602(2). Marking disc 602(1) has a diameter 604 that is similar to a diameter (see diameter 210 of FIG. 2) of flat surface 202 of three-dimensional golf ball marker 104(8). Marking disc 602(2) has a diameter 606 that is similar to a diameter of flat surface 302 of three-dimensional golf ball marker 304(1). However, marking discs 602(1)-(2) may have diameters that are smaller or greater than diameters of the flat surfaces of three-dimensional golf ball marker 104(8) and three-dimensional golf ball marker 304(1), respectively, without departing from the scope hereof. Marking disc 602 may have marking and/or texture similar to three-dimensional golf ball markers 104 and 304, including alignment markings 2802 shown in FIGS. 32, 33 and 40. For example, marking disc 602 may have marking and/or texture to match or complement marking and texture of the three-dimensional golf ball marker.

Figure 7:
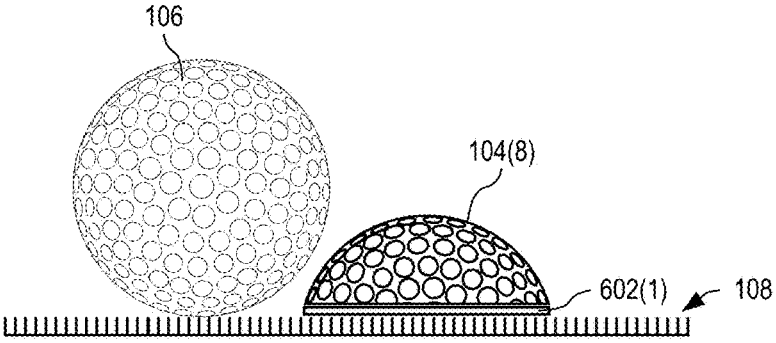
FIG. 7 is a side elevation showing the three-dimensional golf ball marker of FIG. 6 coupled with the marking disc and positioned adjacent to the golf ball on the putting green.

Three-dimensional golf ball marker 104(8) and marking disc 602(1) may be used together to mark golf ball 106 as shown in FIG. 7, and three-dimensional golf ball marker 304(1) and marking disc 602(2) may be similarly used together to mark golf ball 106. FIG. 7 is a side elevation showing three-dimensional golf ball marker 104(8) of FIG. 6 coupled with marking disc 602(1) and positioned adjacent to golf ball 106 on putting green 108. Three-dimensional golf ball marker 104(8) sits on top of marking disc 602(1) on putting green 108.

Figure 8:
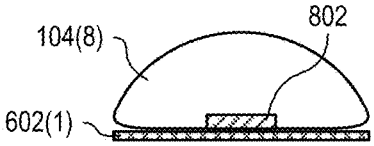
FIG. 8 is a vertical cross section through the center of the three-dimensional golf ball marker of FIG. 6 coupled with the marking disc, showing a magnet recessed into the center of the flat surface to magnetically retain the marking disc thereto, in embodiments.

FIG. 8 is a vertical cross section through the center of three-dimensional golf ball marker 104(8) coupled with marking disc 602(1), showing a magnet 802 recessed into the center of flat surface 202 to magnetically retain marking disc 602(1) thereto. For example, marking disc 602(1) may be, in part, composed of a ferrous material that is attracted by magnet 802. Marking disc 602(2) may be similarly retained by three-dimensional golf ball marker 304(1).

Figure 9:
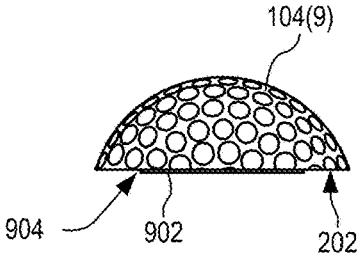
FIG. 9 is a side elevation showing a three-dimensional golf ball marker, similarly shaped to the three-dimensional golf ball marker of FIGS. 1 and 2, and including a removable marking disc positioned within a recess formed in the flat surface, in an embodiment.
Figure 10:
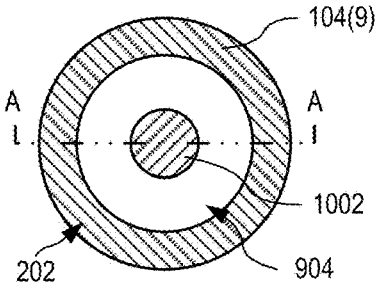
FIG. 10 is a bottom elevation of the three-dimensional golf ball marker of FIG. 9 with the marking disc removed.
Figure 11:
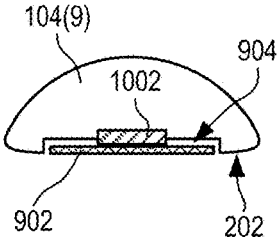
FIGS. 11 and 12 each show a vertical cross section A-A through the three-dimensional golf ball marker and marking disc of FIGS. 9 and 10.
Figure 12:
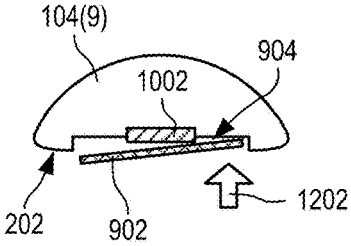

FIG. 9 is a side elevation showing a three-dimensional golf ball marker 104(9), similarly shaped to three-dimensional golf ball marker 104 of FIGS. 1 and 2, and including a removable marking disc 902 positioned within a recess 904 formed in flat surface 202. FIG. 10 is a bottom elevation of three-dimensional golf ball marker 104(9) of FIG. 9 with marking disc 902 removed. FIGS. 11 and 12 each show a vertical cross section A-A through three-dimensional golf ball marker 104(9) and marking disc 902. FIGS. 9 through 12 are best viewed together with the following description. Although not shown in FIGS. 9 through 12, three-dimensional golf ball marker 304 of FIG. 3, may be similarly modified to use and retain marking disc 902.

Recess 904 is circular with a diameter slightly larger than a diameter of marking disc 902 and a depth greater than a thickness of marking disc 902. Accordingly, marking disc 902 fits within recess 904. A magnet 1002 (shown circular, but could be any shape that fits within recess 904) is positioned within recess 904 to retain marking disc 902 parallel to flat surface 202 within recess 904, as shown in FIG. 11. For example, magnet 1002 may be partially recessed into an upper surface of recess 904, with an outer surface parallel to flat surface 202. However, magnet 1002 protrudes beyond the upper surface and into recess 904 such that marking disc 902 does not touch the upper surface when retained by magnet 1002.

Advantageously, marking disc 902 cannot easily slide off magnet 1002, since it is retained by the edges of recess 904. As shown in FIG. 12, to remove marking disc 902 from recess 904, a force 1202 may be applied to one edge of marking disc 902, pushing that edge further into recess 904 and pivoting marking disc 902 against an edge of magnet 1002, thereby freeing the opposite edge of marking disc 902 from recess 904 to allow removal.

Advantageously, marking disc 902 is conveniently stored with three-dimensional golf ball marker 104(9) (or three-dimensional golf ball marker 304) and may be easily removed to mark the position of a golf ball when needed. For example, where a golfer wishes to comply with golf etiquette when another golfer is distracted by three-dimensional golf ball marker 104(9), the golfer may remove marking disc 902 from three-dimensional golf ball marker 104(9) and mark golf ball 106 using only marking disc 902. When golfer 102 replaces golf ball 106 on putting green 108, marking disc 902 may be lifted and replaced within recess 904 of three-dimensional golf ball marker 104(9). In certain embodiment, three-dimensional golf ball marker 104 may clip onto a belt or cap when not in use, for example using magnet 1002 and/or marking disc 902, or other incorporated means for attachment.

Figure 13:
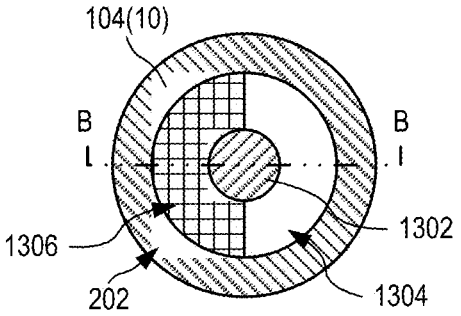
FIG. 13 is a bottom elevation of a three-dimensional golf ball marker with the marking disc removed to show a recess of varying depth, in an embodiment.
Figure 14:
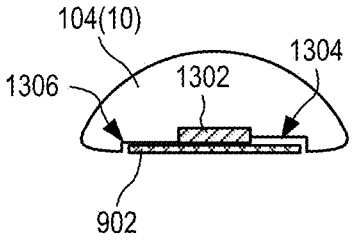
FIG. 14 is a vertical cross section B-B through the three-dimensional golf ball marker of FIG. 13 showing the marking disc retained within the recess by the magnet.
Figure 15:
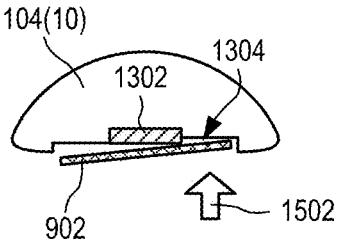
FIG. 15 is a vertical cross section B-B through the three-dimensional golf ball marker of FIGS. 13 and 14 showing the marking disc pushed into the recess for removal.

FIG. 13 is a bottom elevation of a three-dimensional golf ball marker 104(10) with marking disc 902 removed to show a recess 1304 of varying depth. Three-dimensional golf ball marker 104(10) is similar to three-dimensional golf ball marker 104(9), except that a portion 1306 of recess 1304 has reduced depth, such that an upper surface of portion 1306 is flush with a surface of a magnet 1302 positioned to retain a marking disc (e.g., marking disc 902) within recess 1304. FIG. 14 is a vertical cross section B-B through three-dimensional golf ball marker 104(10) showing marking disc 902 retained within recess 1304 by magnet 1302. Advantageously, marking disc 902 cannot easily slide off magnet 1302, since it is retained by the edges of recess 1304. Further, marking disc 902 cannot be depressed into recess 1304 at portion 1306, thereby reducing the probability of marking disc 902 being released accidentally. FIG. 15 is a vertical cross section B-B through three-dimensional golf ball marker 104(10) showing marking disc 902 pushed, as indicated by arrow 1502, into recess 1304 on a side opposite to portion 1306 such that marking disc 902 pivots against magnet 1302 for removal from recess 1304. Force applies to the same side of marking disc 902 as portion 1306 does not release marking disc 902 from recess 1304.

Figure 16:
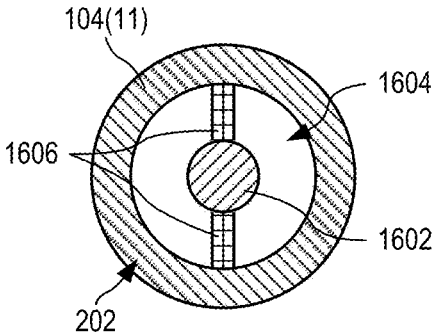
FIG. 16 is a bottom elevation of a three-dimensional golf ball marker, similar to the three-dimensional golf ball marker of FIGS. 9-12, but having a magnet to retain a marking disc within a recess with a bar, in an embodiment.

FIG. 16 is a bottom elevation of a three-dimensional golf ball marker 104(11), similar to three-dimensional golf ball marker 104(10) of FIGS. 9-12, but having a magnet 1602 to retain a marking disc (e.g., marking disc 902) within a recess 1604, where recess 1604 further includes a bar 1606 that has an outer surface that is the same height as magnet 1602. Accordingly, to remove the marking disc from recess 1604, the marking disc may be pushed into recess 1604 either side of bar 1606.

Figure 17:
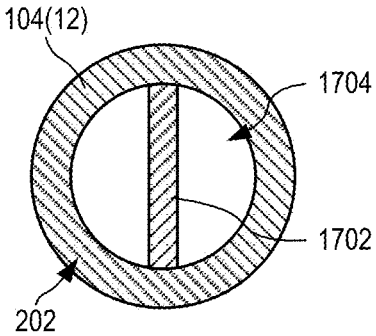
FIG. 17 is a bottom elevation of a three-dimensional golf ball marker, similar to the three-dimensional golf ball marker of FIG. 16 and the three-dimensional golf ball marker of FIGS. 9-12, but having a magnet formed as a bar, in an embodiment.

FIG. 17 is a bottom elevation of a three-dimensional golf ball marker 104(12) that is similar to three-dimensional golf ball marker 104(11) of FIG. 16 and three-dimensional golf ball marker 104(10) of FIGS. 9-12, having a magnet 1702 to retain a marking disc (e.g., marking disc 902) within a recess 1704, where magnet 1702 is formed as a bar. Accordingly, to remove the marking disc from recess 1704, the marking disc may be pushed into recess 1704 either side of magnet 1702.

Figure 18:
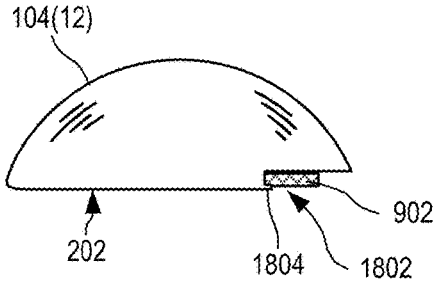
FIG. 18 is a side elevation showing a three-dimensional golf ball marker with a slot storing the marking disc, in an embodiment.
Figure 19:
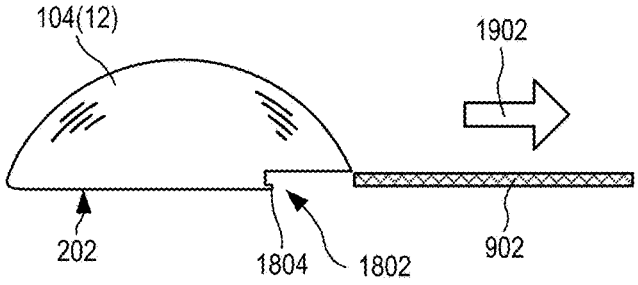
FIG. 19 is a side elevation showing the three-dimensional golf ball marker of FIG. 18 with the marking disc removed from the slot.
Figure 20:
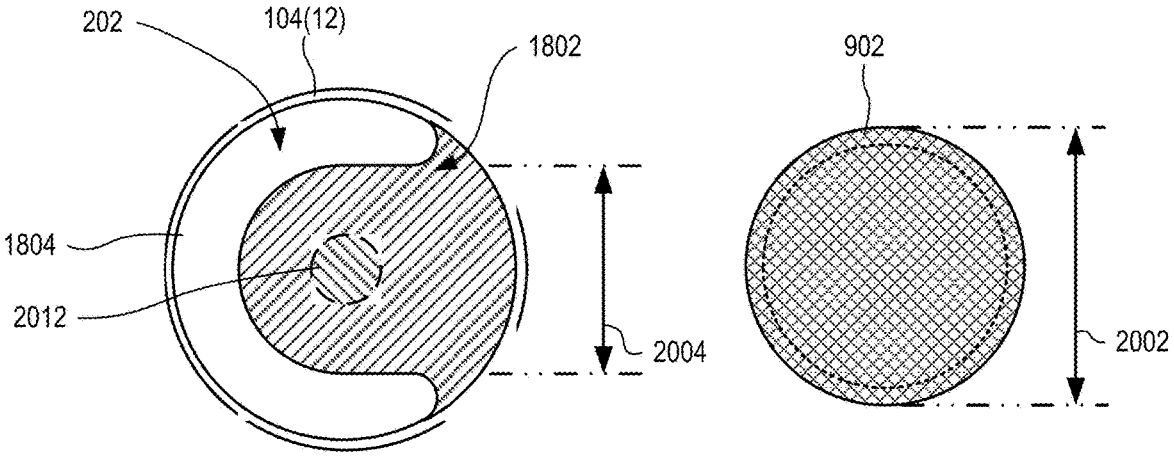
FIG. 20 is a bottom view of the three-dimensional golf ball marker of FIGS. 18 and 19 with the marking disc removed.
Figure 21:
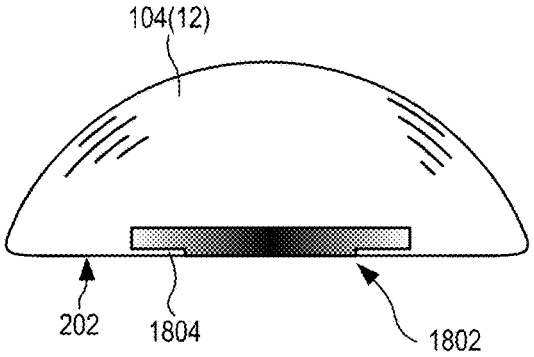
FIG. 21 is a front elevation showing the three-dimensional golf ball marker of FIGS. 18, 19 and 20 with the marking disc removed.

FIG. 18 is a side elevation showing a three-dimensional golf ball marker 104(12) with a slot 1802 storing marking disc 902. FIG. 19 is a side elevation showing three-dimensional golf ball marker 104(12) of FIG. 18 with marking disc 902 removed from slot 1802. FIG. 20 is a bottom view of three-dimensional golf ball marker 104(12) of FIGS. 18 and 19 with marking disc 902 removed. FIG. 21 is a front elevation showing three-dimensional golf ball marker 104 (12) of FIGS. 18, 19 and 20 with marking disc 902 removed. FIGS. 18 through 21 are best viewed together with the following description.

Three-dimensional golf ball marker 104(12) is similar, in shape, size, and use, to three-dimensional golf ball marker 104 of FIGS. 1 and 2, and further includes slot 1802 for receiving and temporarily securing a marking disc (e.g., marking disc 902 of FIG. 9). Slot 1802 is formed at flat surface 202 of three-dimensional golf ball marker 104(12) and has a width similar to a diameter 2002 of marking disc 902. Slot 1802 includes a semi-circular lip 1804 that has an internal diameter 2004 that is smaller than diameter 2002 of marking disc 902. Accordingly, marking disc 902 is retained within slot 1802 by lip 1804. When marking disc 902 is inserted into slot 1802, lip 1804 and marking disc 902 collectively form a bottom of three-dimensional golf ball marker 104(12). In certain embodiments, lip 1804 may form a smaller portion of flat surface 202 than marking disc 902. In other embodiments, lip 1804 forms a greater portion of flat surface 202 than marking disc 902.

In certain embodiments, slot 1802 and marking disc 902 may be sized to have a frictional fit, where friction prevents marking disc 902 from sliding out of slot 1802. In other embodiments, a magnet 2012 (similar to magnet 1002 of FIGS. 10, 11 and 12) may be recessed into an upper surface of slot 1802 to retain marking disc 902 within slot 1802. In another embodiment, slot 1802 may be configured with a retaining mechanism, such as a spring, that removably retains marking disc 902 within slot 1802. Accordingly, marking disc 902 may be conveniently stored with three-dimensional golf ball marker 104(12) and is easily removed for marking the position of golf ball 106 on putting green 108 when needed.

Figure 22:
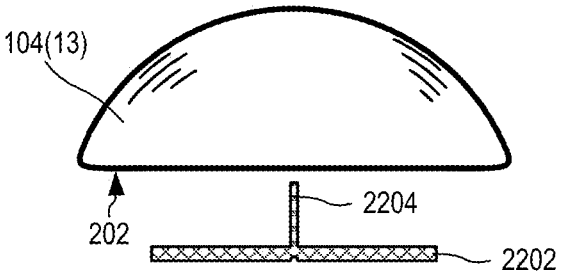
FIG. 22 is a side elevation showing a three-dimensional golf ball marker with a spiked marking disc, in an embodiment.
Figure 23:
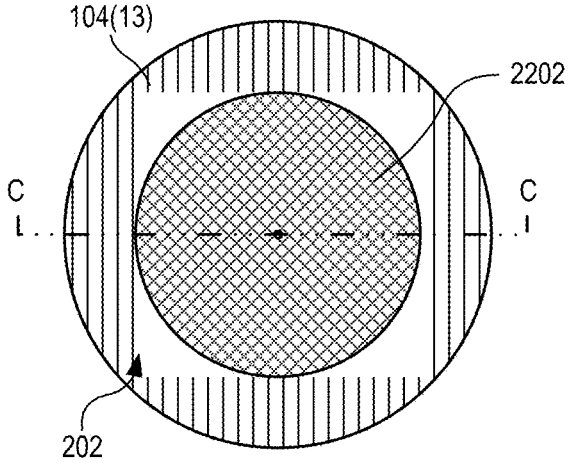
FIG. 23 is a bottom elevation of the three-dimensional golf ball marker and the spiked marking disc of FIG. 22 coupled together.
Figure 24:
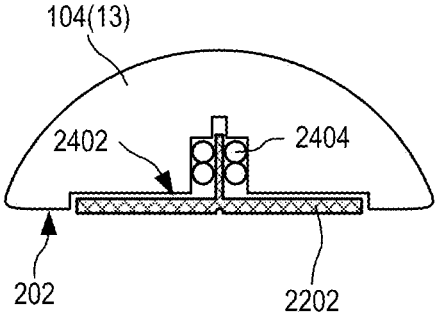
FIG. 24 is a vertical cross section C-C of the three-dimensional golf ball marker and the spiked marking disc of FIGS. 22 and 23.

FIG. 22 is a side elevation showing a three-dimensional golf ball marker 104(13) with a spiked marking disc 2202 that has a spike/pin 2204. Spiked marking disc 2202 is shown in an orientation (inverted) for coupling with three-dimensional golf ball marker 104(13). FIG. 23 is a bottom elevation of three-dimensional golf ball marker 104(13) and spiked marking disc 2202 of FIG. 22 coupled together. FIG. 24 is a vertical cross section C-C of three-dimensional golf ball marker 104(13) and spiked marking disc 2202 of FIGS. 22 and 23. FIGS. 22-24 are best viewed together with the following description.

Three-dimensional golf ball marker 104(13) is formed with a recess 2402, in flat surface 202, for receiving and storing spiked marking disc 2202 such that spiked marking disc 2202 is flush with flat surface 202. In other embodiments, recess 2402 is configured such that spiked marking disc 2202, when coupled with three-dimensional golf ball marker 104(13), protrudes beyond flat surface 202. Recess 2402 includes a retaining mechanism 2404 that grips spike/pin 2204 to removably retain spiked marking disc 2202 within recess 2402. Retaining mechanism 2404 is for example a spring, rubber grommet, clasp, or other such mechanism, that is fixedly coupled with three-dimensional golf ball marker 104(13) and operates to grip spike/pin 2204 such that spiked marking disc 2202 is safely retained within recess 2402 during carrying and normal use of three-dimensional golf ball marker 104(13).

Figure 25:
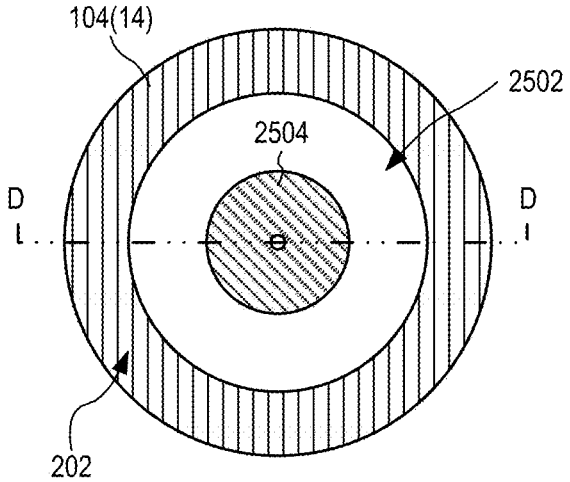
FIG. 25 is a bottom elevation of a three-dimensional golf ball marker, that is similar to the three-dimensional golf ball marker of FIGS. 22-24, where a spiked marking disc is retained within a recess by a magnet, in an embodiment.
Figure 26:
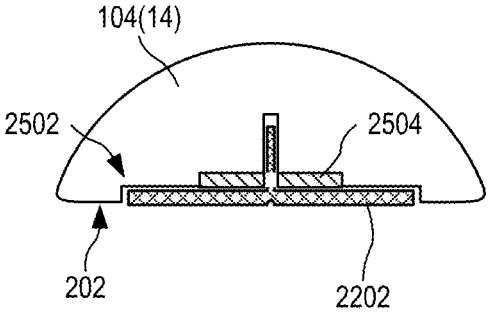
FIG. 26 is a vertical cross section D-D of the three-dimensional golf ball marker of FIG. 25, showing the magnet positioned to attract and retain the spiked marking disc within the recess.

FIG. 25 is a bottom elevation of a three-dimensional golf ball marker 104(14), that is similar to three-dimensional golf ball marker 104(13) of FIGS. 22-24, where a spiked marking disc 2202 is retained within a recess 2502 by a magnet 2504. FIG. 26 is a vertical cross section D-D of three-dimensional golf ball marker 104(14), showing magnet 2504 positioned to attract and retain spiked marking disc 2202 within recess 2502. Although shown circular and recessed, magnet 2504 may have other shapes and positions without departing from the scope hereof.

Figure 27:
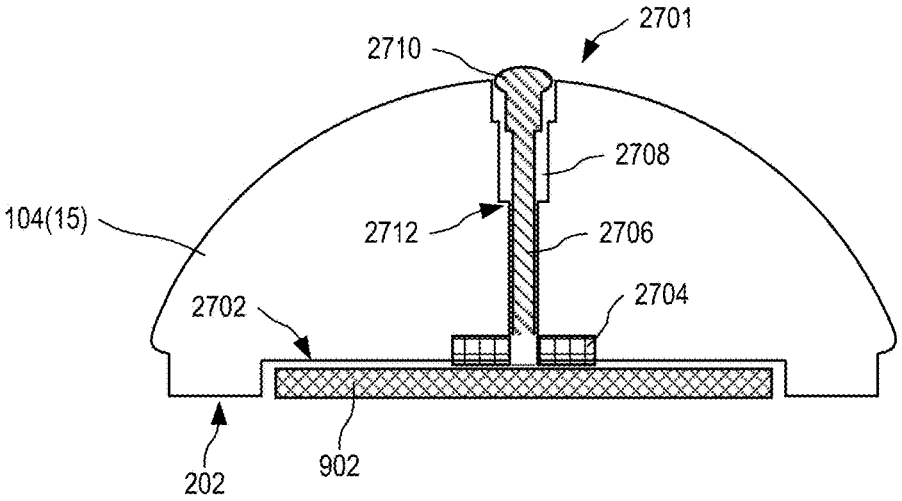
FIG. 27 is a vertical cross section through a three-dimensional golf ball marker configured with an example ejection mechanism for ejecting the marking disc from a recess, in an embodiment.

FIG. 27 is a vertical cross section through a three-dimensional golf ball marker 104(15) configured with an example ejection mechanism 2701 for ejecting marking disc 902 from a recess 2702. Marking disc 902 is retained within recess 2702 by a magnet 2704, similarly to three-dimensional golf ball marker 104(9) of FIGS. 9-12. However, marking disc 902 may be retained by other means without departing from the scope hereof. For example, marking disc 902 may be retained by one or more of friction, suction, adhesion, and so on.

Ejection mechanism 2701 includes a rod 2706, a return spring 2708, and a button 2710, positioned within a vertical shaft 2712 of three-dimensional golf ball marker 104(15). Button 2710 is positioned at a top opening of shaft 2712 and may be depressed by golfer 102 such that rod 2706 extends from a lower opening of shaft 2712 to push marking disc 902 away from magnet 2704 and out of recess 2702. When released, return spring 2708 retracts rod 2706 into shaft 2712 such that marking disc 902 may be replaced within recess 2702 and retained by magnet 2704. Ejection mechanism 2701 may use other methods for retracting rod 2706 without departing from the scope hereof. For example, return spring 2708 may be replaced by a rubber bush or other similar material that returns to its original shape after being depressed.

Figure 37:
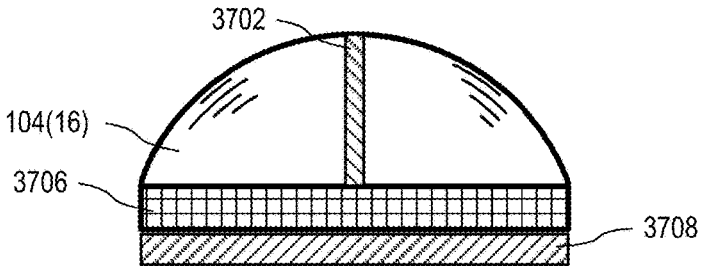
FIGS. 37-39 show a three-dimensional golf ball marker, similar to the three-dimensional golf ball markers of FIG. 8, with a large marking disc that includes a smaller marking disc, in an embodiment.
Figure 38:
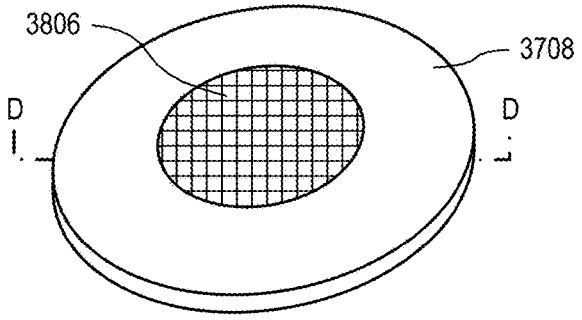
Figure 39:
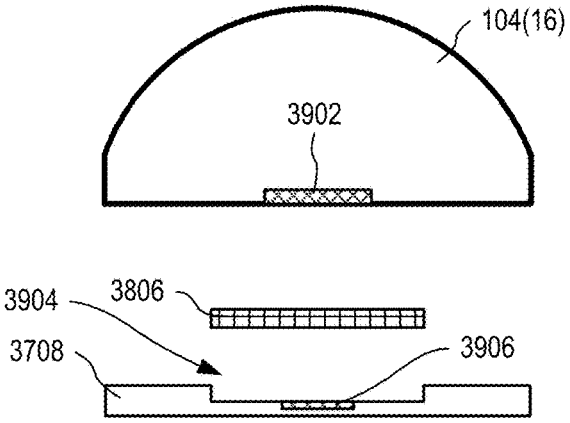

FIGS. 37-39 show a three-dimensional golf ball marker 104(16), similar to three-dimensional golf ball markers 104 of FIG. 8, that includes a large marking disc 3708 that includes a smaller marking disc 3806. The three-dimensional golf ball marker 104(16) includes a bottom rim 3706 and an alignment marking 3702. In the example of FIGS. 37-39, large marking disc 3708 has a diameter similar to three-dimensional golf ball marker 104(16) and is retained by a magnet 3902. Large marking disc 3708 includes a recess 3904 for receiving smaller marking disc 3806, which is retained by a magnet 3906 positioned within recess 3904. Three-dimensional golf ball marker 104(16) may be used to mark a golf ball (e.g., golf ball 106) while coupled with larger marking disc 3708 and smaller marking disc 3806, or may be used without larger marking disc 3708 and smaller marking disc 3806. Larger marking disc 3708 may be used to mark a golf ball while coupled with smaller marking disc 3806, or may be used without smaller marking disc 3806. Smaller marking disc 3806 may be used to mark a gold ball without three-dimensional golf ball marker 104(16) and large marking disc 3708. Large marking disc 3708 and small marking disc 3806 may also include markings, similar to, or different from, alignment marking 3702.

Figure 28:
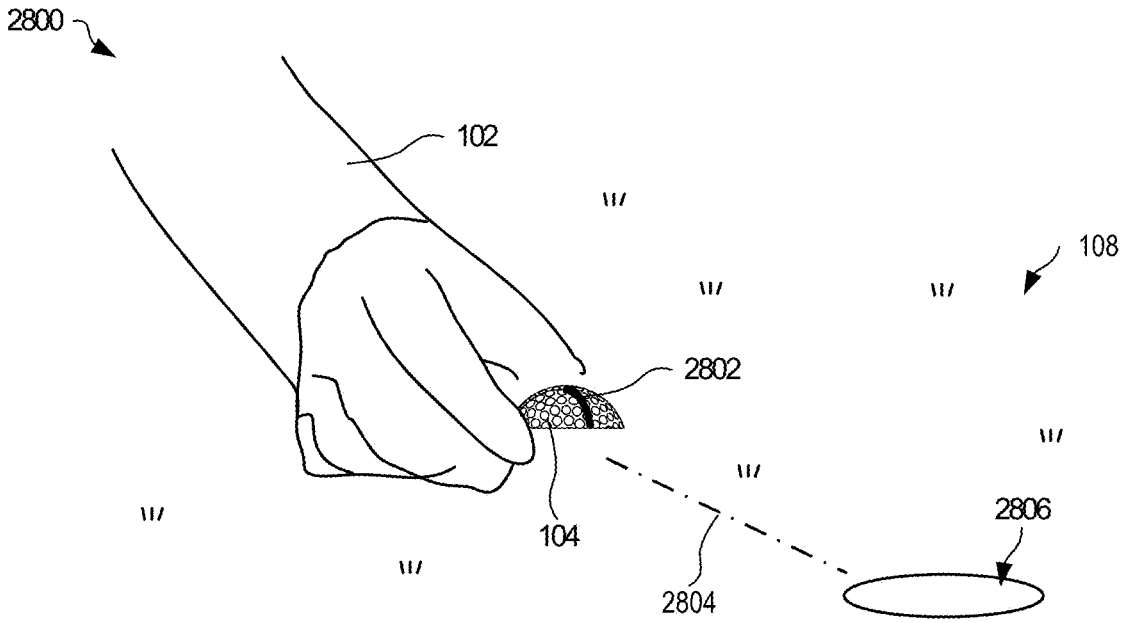
FIG. 28 is a perspective view of golfer aligning an alignment mark of a three-dimensional golf ball marker with an intended line for a golf ball to follow towards a hole in a putting green, in an embodiment.
Figure 29:
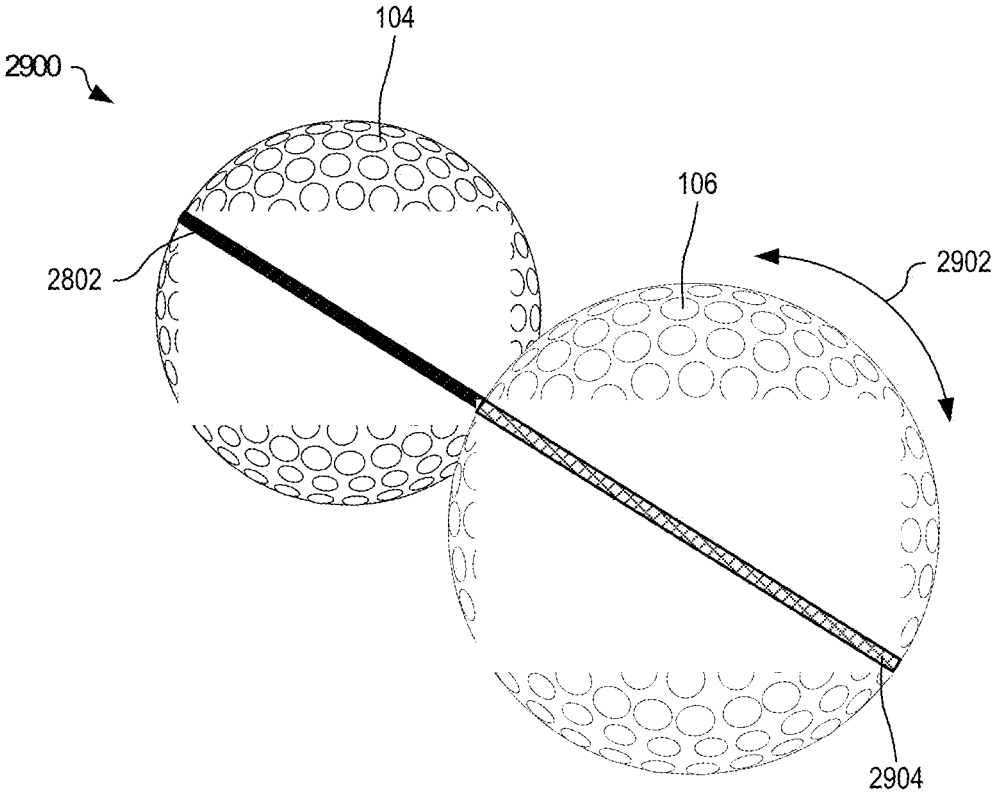
FIG. 29 is a top view illustrating how the golf ball may be rotated to align a mark thereon with the alignment mark of the three-dimensional golf ball marker of FIG. 28.

FIG. 28 is a perspective view 2800 of golfer 102 aligning an alignment mark 2802 of three-dimensional golf ball marker 104 with an intended line 2804 for a golf ball to follow towards a hole 2806 in putting green 108. FIG. 29 is a top view 2900 illustrating how golf ball 106 may be rotated 2902 to align a mark 2904 thereon with alignment mark 2802 of three-dimensional golf ball marker 104 of FIG. 28. Advantageously, use of three-dimensional golf ball marker 104 with alignment mark 2802 facilitates alignment of mark 2904 of golf ball 106 with intended line 2804.

Figure 30:
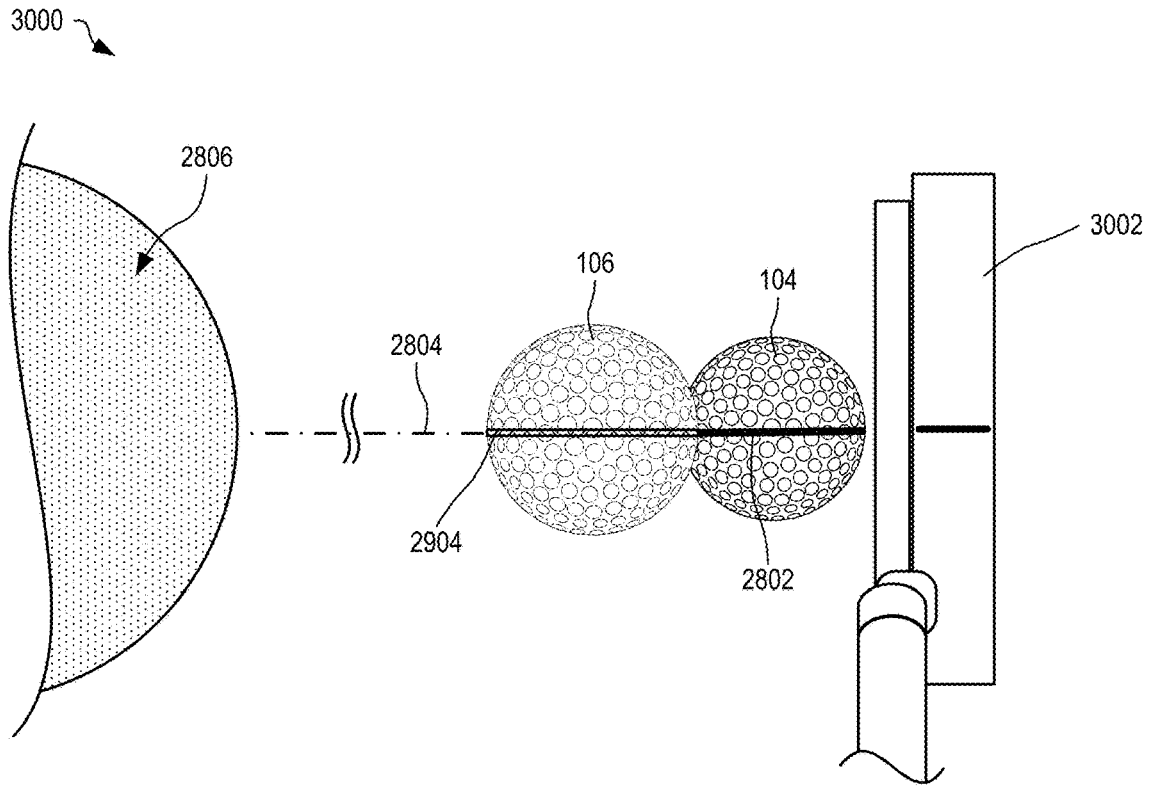
FIG. 30 is a top view illustrating alignment of a putter blade of FIG. 29 with both the alignment mark of the three-dimensional golf ball marker and the mark of the golf ball.
Figure 31:
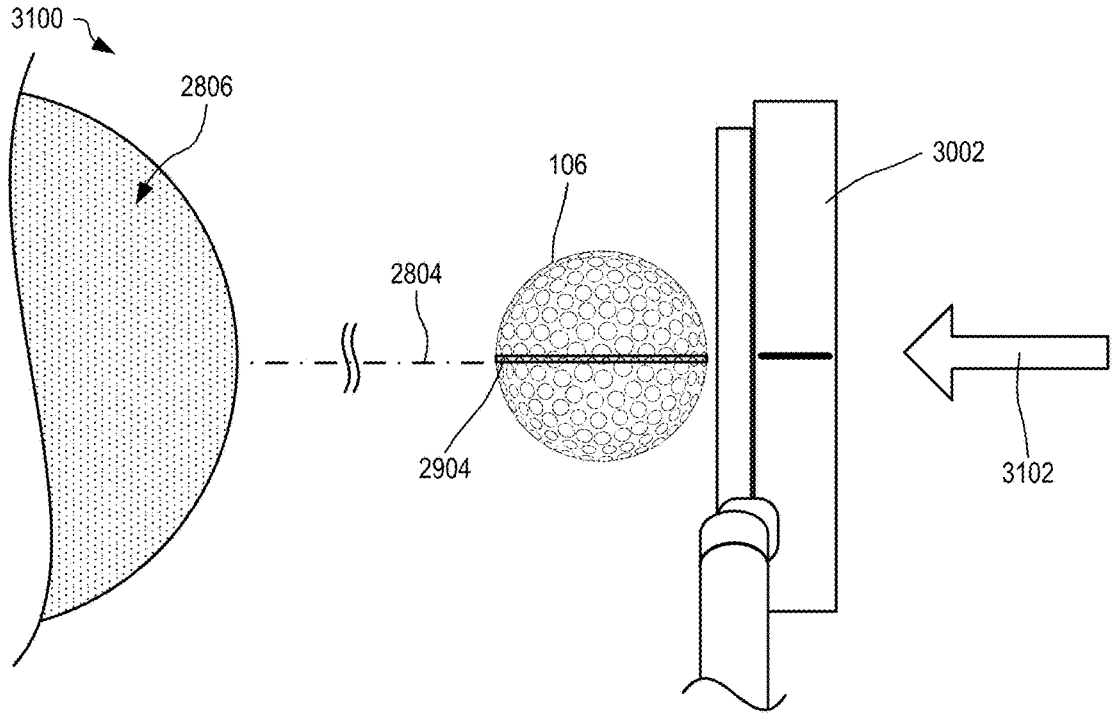
FIG. 31 is a top view illustrating alignment of the putter blade of FIG. 30 with the mark of the golf ball, when the three-dimensional golf ball marker is removed.

FIG. 30 is a top view 3000 illustrating alignment of a putter blade 3002 with both alignment mark 2802 of three-dimensional golf ball marker 104 and mark 2904 of golf ball 106. FIG. 31 is a top view 3100 illustrating alignment of putter blade 3002 with mark 2904 of golf ball 106, when three-dimensional golf ball marker 104 is removed. Advantageously, the use of alignment mark 2802 and mark 2904 together provides a greater marked length that may improve alignment to intended line 2804, and thereby improving results for a subsequent putting stroke 3102.

In the example of FIGS. 28-31, alignment mark 2802 is a single line following a vertical plane through three-dimensional golf ball marker 104. However, alignment mark 2802 may take other forms, such as shown in the examples of FIGS. 32, 33, and 40, without departing from the scope of the embodiments herein. Marking of golf ball 106 is known, but the inclusion of alignment mark 2802 on three-dimensional golf ball marker 104 (or three-dimensional golf ball marker 304, FIG. 3) is unknown.

In one example of operation, as golfer 102 places three-dimensional golf ball marker 104 behind golf ball 106 (not shown in FIG. 28 for clarity of illustration), golfer 102 may align alignment mark 2802 with an intended line 2804 towards hole 2806. Advantageously, golfer 102 may continue reading putting green 108 to determine intended line 2804, while golf ball 106 is lifted and other golfers play for example. Golfer 102 may adjust the alignment of the three-dimensional golf ball marker 104, and when replacing golf ball 106 on putting green 108, golfer 102 may align mark 2904 of golf ball 106 with alignment mark 2802 of three-dimensional golf ball marker 104, as shown in FIG. 29, before removing three-dimensional golf ball marker 104. Optionally, as shown in FIG. 30, golfer 102 may align putter blade 3002 with both alignment mark 2802 and mark 2904 as a check of veracity of intended line 2804. When three-dimensional golf ball marker 104 is removed, golfer 102 may then align putter blade 3002 with mark 2904 with greater assurance that intended line 2804 is correct and that putter blade 3002 and putting stroke 3102 are correctly aligned before putting golf ball 106.

Advantageously, the process of reading the putting green 108 is expedited, since golfer 102 may visually use three-dimensional golf ball marker 104 to determine intended line 2804 without having to wait until golf ball 106 is replaced onto putting green 108.

Figure 32:
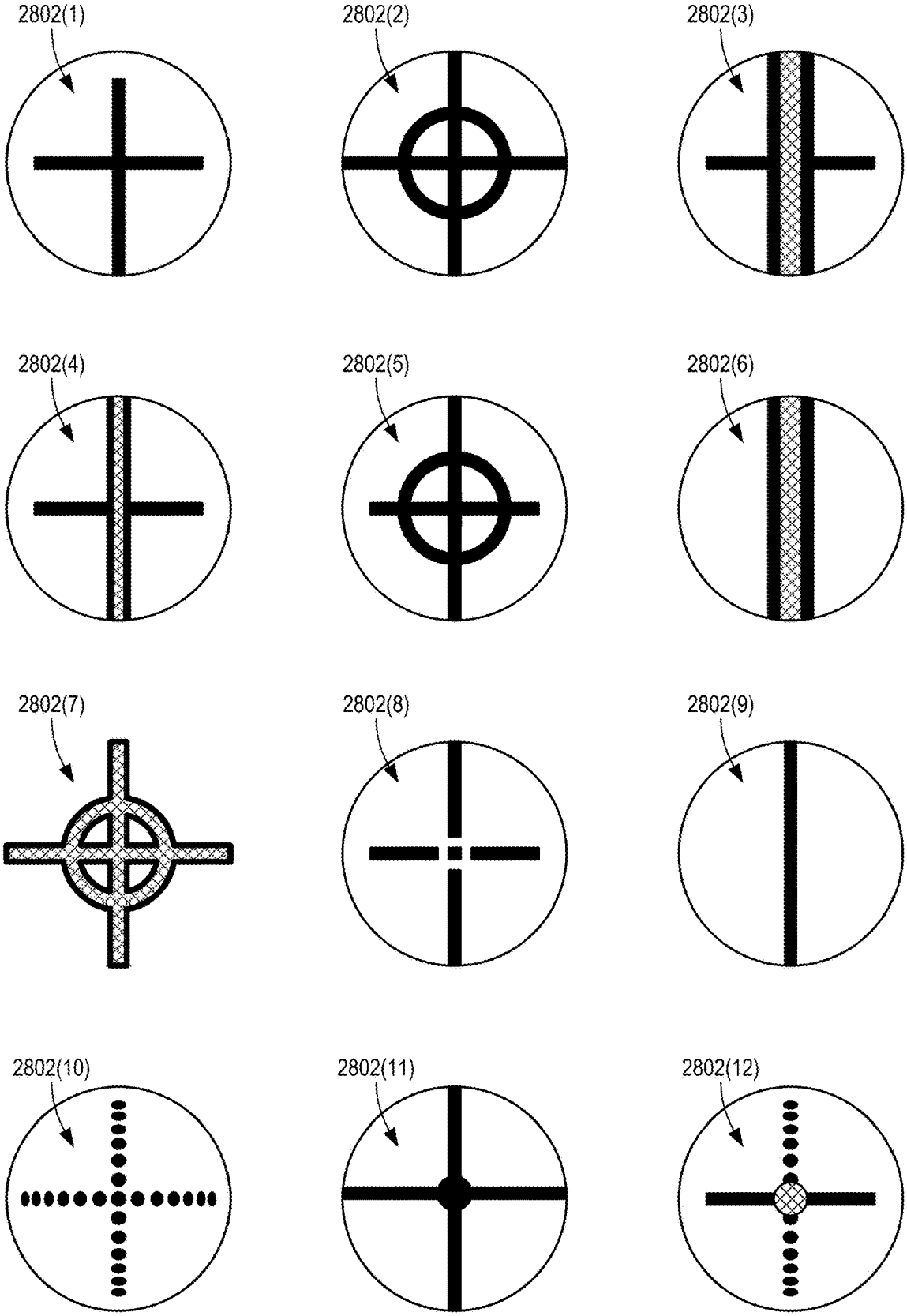
FIGS. 32, 33 and 40 show a plurality of example alignment marks that may be incorporated with any of the three-dimensional golf ball markers of FIGS. 1 through 31, in embodiments.
Figure 33:
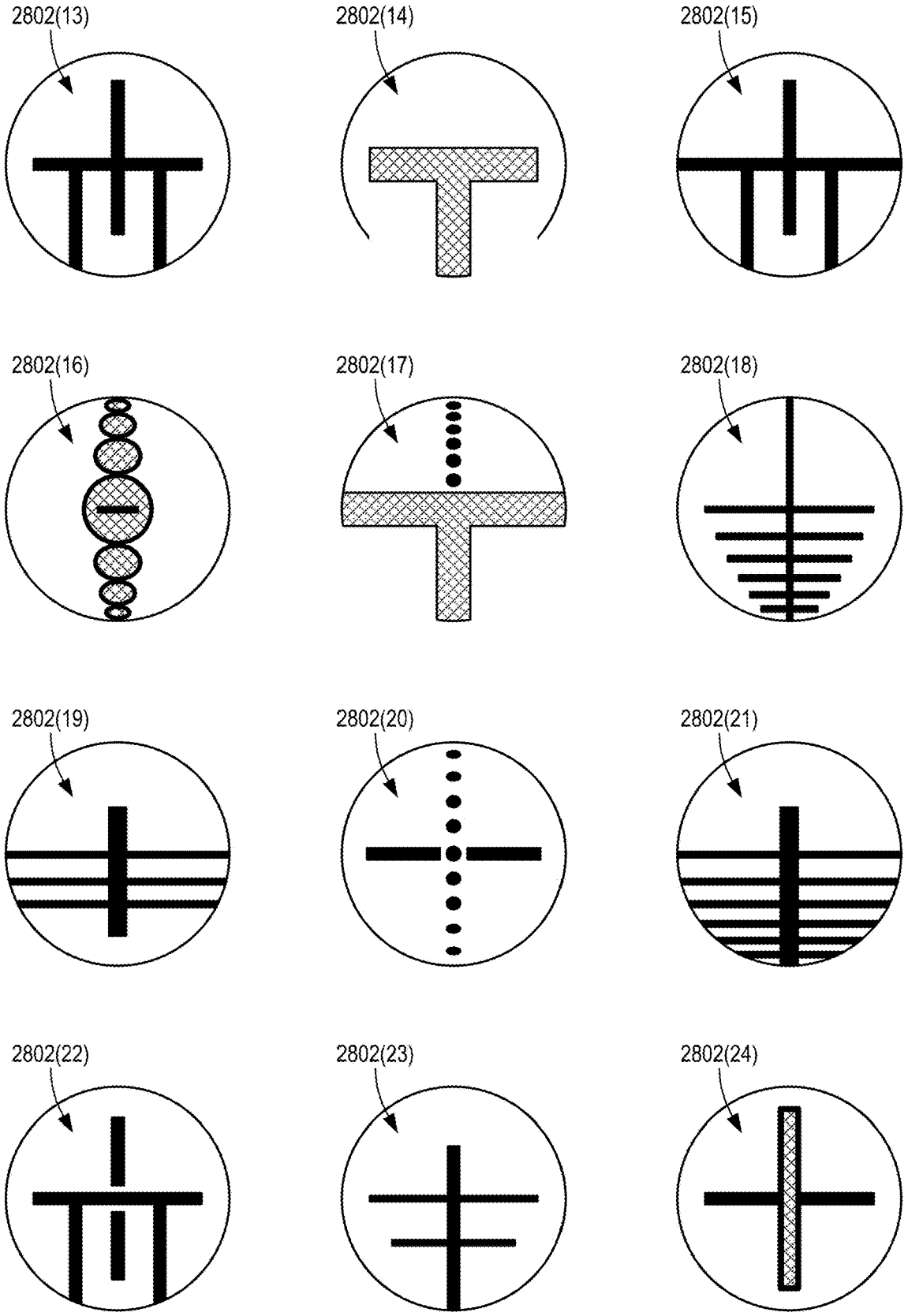
Figure 40:
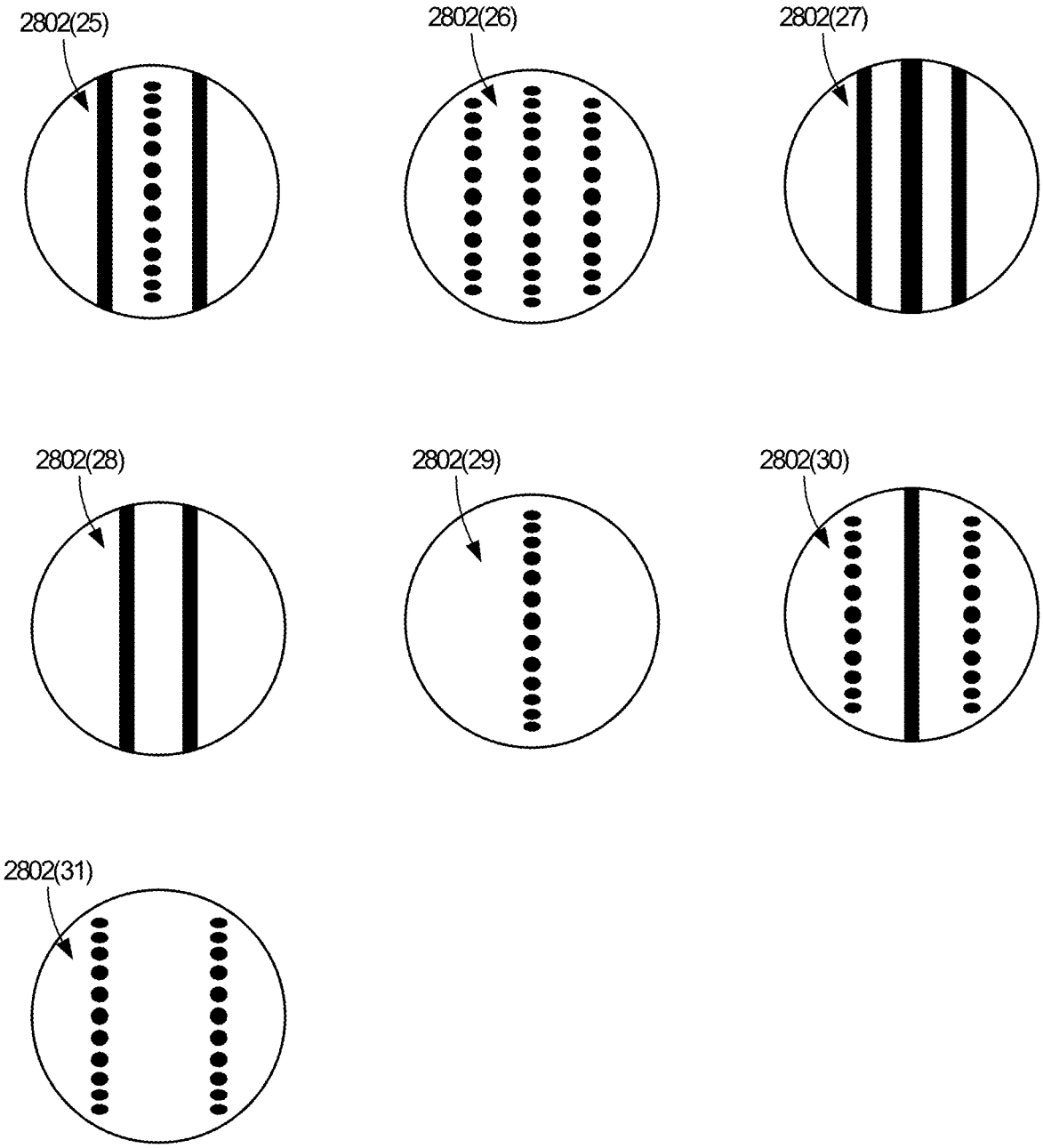

FIGS. 32, 33, and 40 show a plurality of example alignment marks 2802(1)-2802(31) that may be incorporated with any of three-dimensional golf ball markers 104 and 304 of FIGS. 1 through 31. Particularly, alignment marks 2802(1)-2802(31) may be selected to facilitate alignment of three-dimensional golf ball markers 104, 304 with an intended line (e.g., intended line 2804) for golf ball 106 to follow. Alignment marks 2802 may also be incorporated onto any of marking discs 602, 902, and spiked marking disc 2202, such that golfer 102 may still visually prepare the intended line when three-dimensional golf ball markers 104, 304 are not used.

Alignment Rotation

Figure 41:
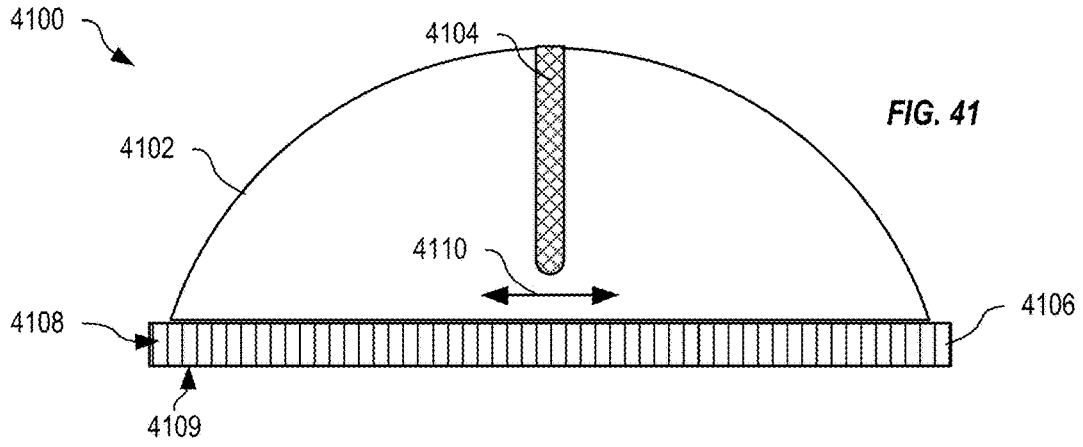
FIGS. 41-42 show a three-dimensional golf ball marker, similar to the three-dimensional golf ball markers of FIG. 5, with a rotatable alignment marking, in an embodiment.
Figure 42:
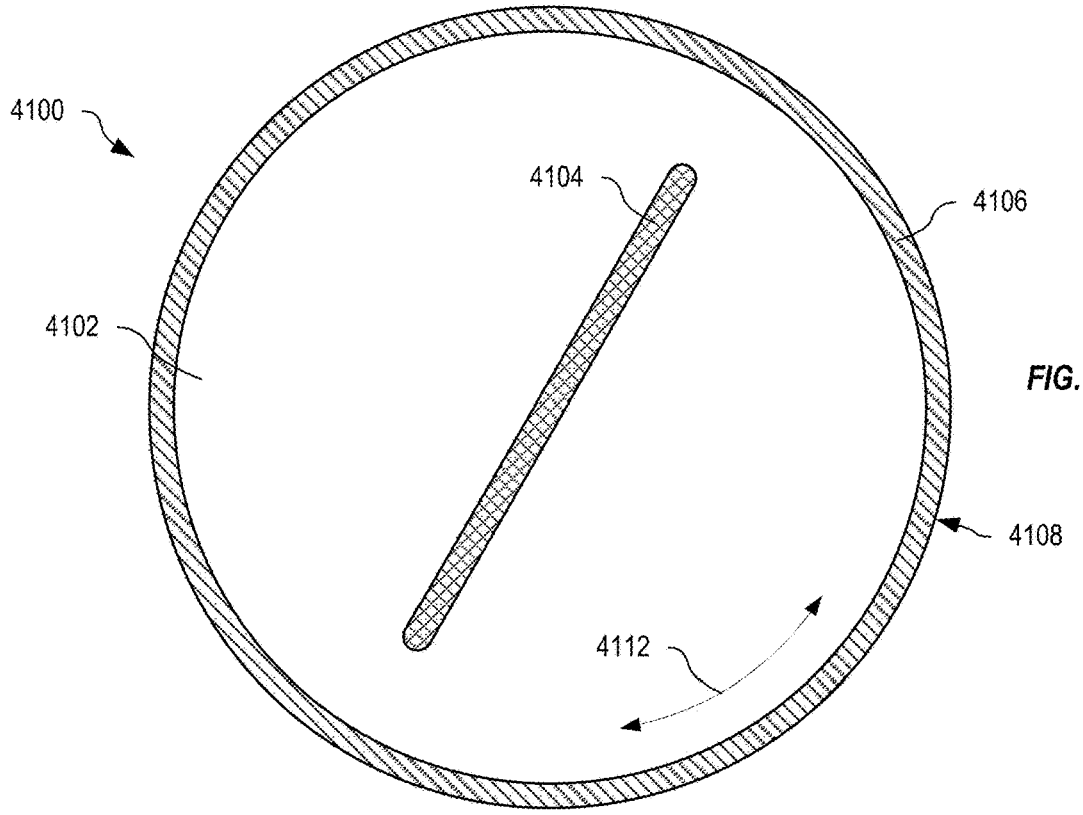

According to the rules of golf, once a ball marker has been placed on a green to mark a golf ball, the ball marker should not be moved until the golf ball is replaced. FIGS. 41 and 42 show a three-dimensional golf ball marker 4100, similar to the three-dimensional golf ball markers 104(5)-(7) of FIG. 5, but configured with a rotatable alignment marking. FIGS. 41-42 are best viewed together with the following description.

Three-dimensional golf ball marker 4100 has an outer shell 4102 that is semi-spherical in shape with an alignment marking 4104 on an outer surface. Outer shell 4102 is rotationally and removably attached to a base 4106 that may have an outer knurled (or similar) surface 4108 to facilitate gripping thereof and a bottom surface 4109 that contacts the green when three-dimensional golf ball marker 4100 is positioned to mark a golf ball. In certain embodiments, bottom surface 4109 may have a textured or coated surface to resist accidental movement of three-dimensional golf ball marker 4100 relative to the green. Three-dimensional golf ball marker 4100 may also include a removable marking disc 4120 that may be removed from base 4106 as needed.

Figure 43:
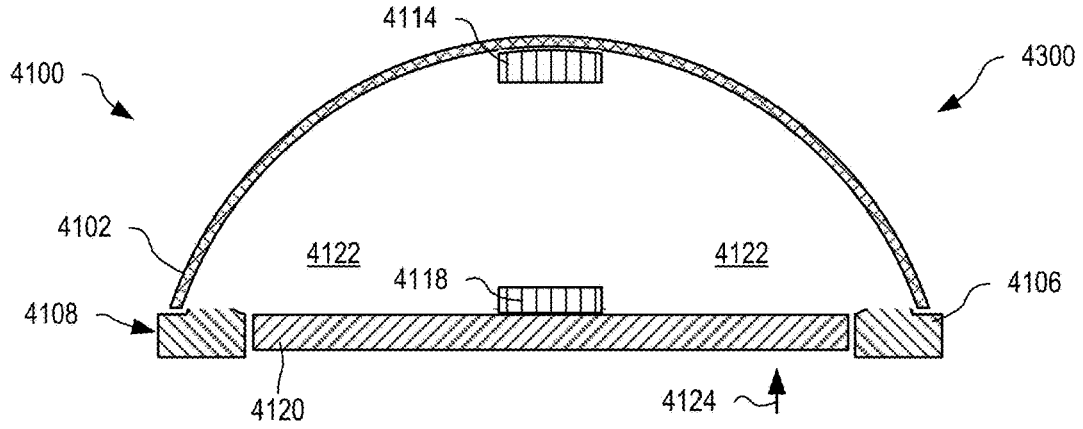
FIG. 43 is a cross-section of the 3D golf ball marker of FIGS. 41 and 42, illustrating a first internal configuration, in an embodiment.

FIG. 43 is a cross-section of 3D golf ball marker 4100 of FIGS. 41 and 42, illustrating a first internal configuration 4300. Base 4106 has a semi-spherical upper portion that fits within outer shell 4102 and includes a first magnet 4114, secured at a top portion of base 4106, to magnetically retain outer shell 4102 with base 4106. Advantageously, first magnet 4114 allows outer shell 4102 to rotate, as indicated by arrows 4110 and 4112, while outer shell 4102 is magnetically retained with base 4106. Accordingly, alignment marking 4104 may be rotated without moving base 4106.

Base 4106 may include a second magnet 4118 positioned within a recess 4122 to retain a marking disc 4120 within recess 4122. Recess 4122 functions similarly to recess 1304 of FIGS. 13-15 to allow removal of marking disc 4120 from base 4106 (e.g., by pressing one side of marking disc 4120 into recess 4122 as indicated by arrow 4124) as needed.

Advantageously, outer shell 4102 may be removed from base 4106 for cleaning and/or swapping with another outer shell 4102 with different alignment marking 4104. Although shown as a single line, alignment marking 4104 may be implemented as any one of alignment markings 2802 of FIGS. 32, 33 and 40. Similarly, an outer surface of outer shell 2102 may have textures and/or coatings as described above without departing from the scope hereof.

Figure 44:
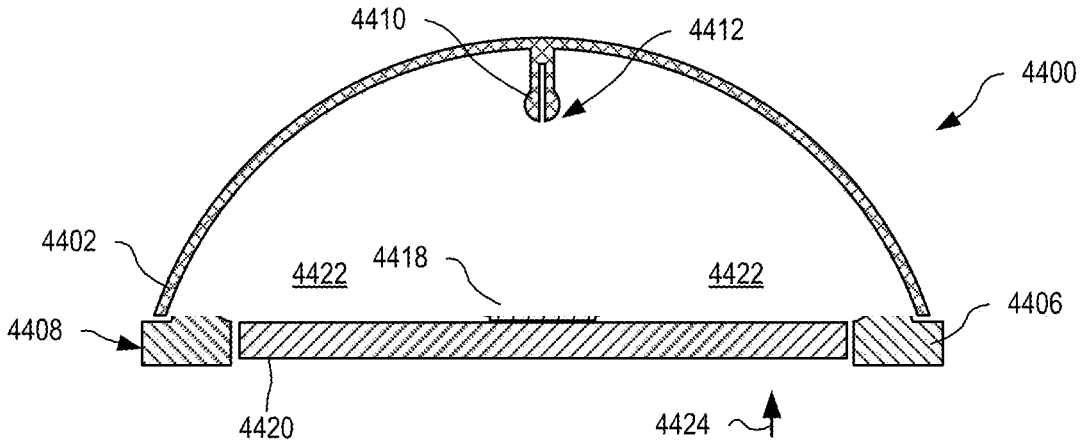
FIG. 44 is a cross-section of the 3D golf ball marker of FIGS. 41 and 42 illustrating a second internal configuration, in an embodiment.

FIG. 44 is a cross-section of a 3D golf ball marker 4400 that is similar to 3D golf ball marker 4100 of FIGS. 41 and 42, but includes a second pivot mechanism that allows rotation of an outer shell 4402, which is semi-spherical in shape with an alignment marking on an outer surface, relative to a base 4406. Outer shell 4402 includes a shaped split pin 4410 positioned within the semi-spherical outer shell 4402 to mate with a shaped receptacle 4412 positioned at the top of base 4406. Particularly, the matching shapes of split pin 4410 and receptacle 4412 retains outer shell 4402 on base 4406 and allows outer shell 4402 to be rotated relative to base 4406.

Similar to 3D golf ball marker 4100, base 4406 includes a magnet 4418 positioned within a recess 4422 to retain a marking disc 4420 within recess 4422. Recess 4422 functions similarly to recess 1304 of FIGS. 13-15 to allow removal of marking disc 4420 from base 4406 (e.g., by pressing one side of marking disc 4420 into recess 4422 as indicated by arrow 4424) as needed. Advantageously, outer shell 4402 may be removed from base 4406 for cleaning and/or swapping with another outer shell 4402 with different alignment markings.

Figure 45:
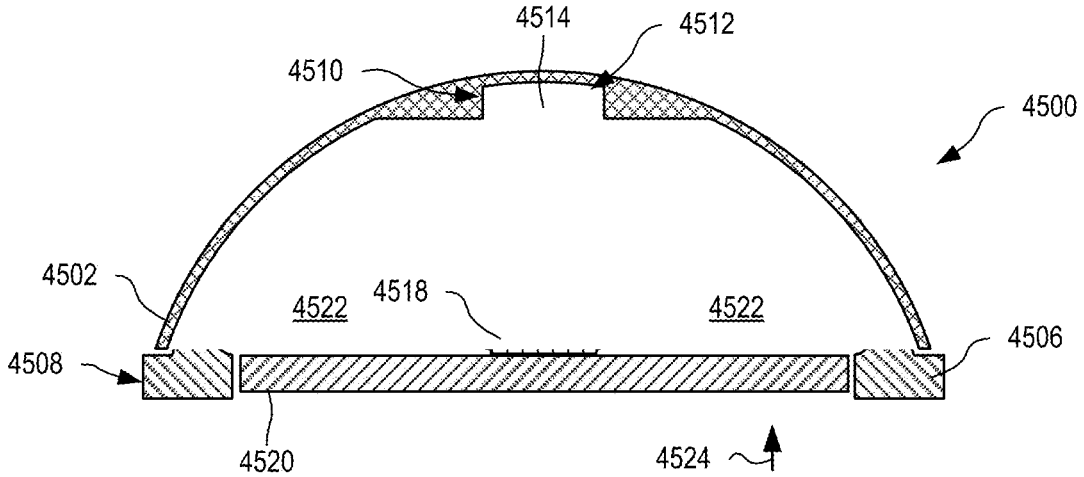
FIG. 45 is a cross-section of the 3D golf ball marker of FIGS. 41 and 42 illustrating a third internal configuration, in an embodiment.

FIG. 45 is a cross-section of a 3D golf ball marker 4500 that is similar to 3D golf ball marker 4100 of FIGS. 41 and 42, but includes a third pivot mechanism that allows rotation of an outer shell 4502, which is semi-spherical in shape with an alignment marking on an outer surface, relative to a base 4506. An internal central portion of outer shell 4502 forms a recess 4512 shaped to receive and frictionally retain a ball bearing race 4510. Base 4506 has a post 4514 positioned at a top surface to frictionally mate with ball bearing race 4510 such that outer shell 4502 is retained with base 4506 but may be easily rotated. Base 4506 may have an outer knurled (or similar) surface 4508 to facilitate gripping thereof. Although these examples use a ball bearing race, other typed of bearing may be used without departing from the scope of the embodiments described herein.

Similar to 3D golf ball marker 4100, base 4506 includes a magnet 4518 positioned within a recess 4522 to retain a marking disc 4520 within recess 4522. Recess 4522 functions similarly to recess 1304 of FIGS. 13-15 to allow removal of marking disc 4520 from base 4506 (e.g., by pressing one side of marking disc 4520 into recess 4522 as indicated by arrow 4524) as needed. Advantageously, outer shell 4502 may be removed from base 4506 for cleaning and/or swapping with another outer shell 4502 with different alignment markings.

FIGS. 46-49 are cross-sections of a 3D golf ball marker similar to the 3D golf ball marker of FIGS. 37-39, illustrating example internal swivel mechanisms that allow rotation of the alignment marking with respect to the base of the 3D golf ball marker.

Figure 46:
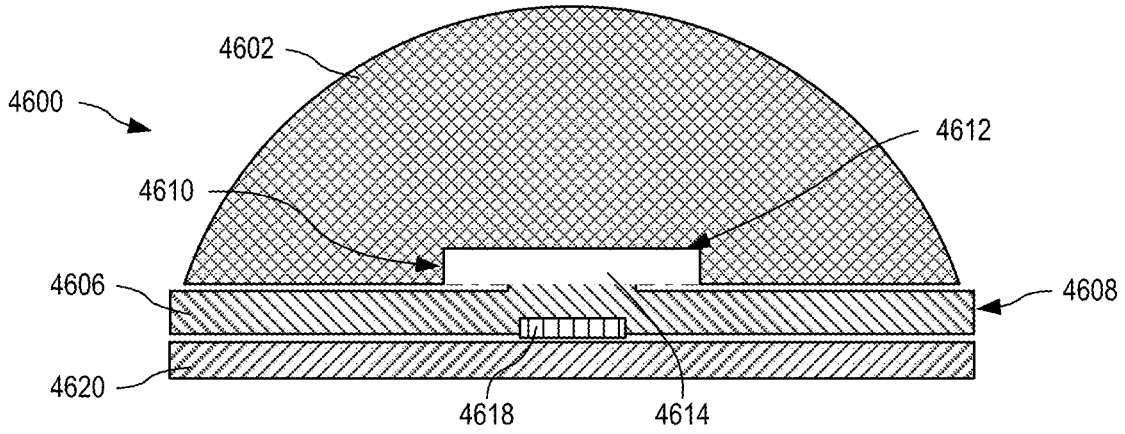
FIGS. 46-49 are cross-sections of a 3D golf ball marker similar to the 3D golf ball marker of FIGS. 37-39, illustrating alternative internal configurations that allow rotation of the alignment marking, in embodiments.

FIG. 46 is a cross-section of a 3D golf ball marker 4600 that is similar to 3D golf ball marker 104(16) of FIGS. 37-39, but includes a fourth pivot mechanism that allows rotation of a top portion 4602, which may be semi-spherical in shape with an alignment marking on an outer surface, relative to a base 4606. Top portion 4602 has a recess 4612 formed in a lower surface to receive and frictionally retain a ball bearing race 4610. Base 4606 is a flat disc with a raised post on the center of one side that fractionally engages with ball bearing race 4610 such that top portion 4602 and base 4606 are rotatably coupled together. Base 4606 may have an outer knurled (or similar) surface 4608 to facilitate gripping thereof. In certain embodiments, a lower face of base 4606 may include a magnet 4618 that magnetically retains a large marking disk 4620 against base 4606. Large marking disk 4620 may be similar to large marking disc 3708, and may include a smaller marking disc (not shown) that is similar to smaller marking disc 3806.

Figure 47:
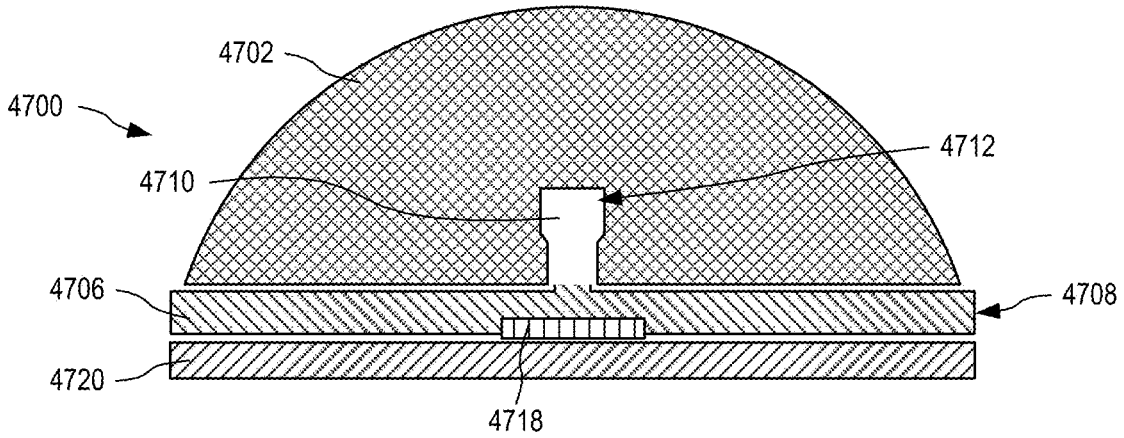

FIG. 47 is a cross-section of a 3D golf ball marker 4700 that is similar to 3D golf ball marker 104(16) of FIGS. 37-39, but includes a fifth pivot mechanism that allows rotation of a top portion 4702, which may be semi-spherical in shape with an alignment marking on an outer surface, relative to a base 4706. Top portion 4702 has a shaped recess 4712 formed in a lower surface to receive and frictionally retain a shaped split pin 4710 of base 4706. Base 4606 is a flat disc with shaped split pin 4710 extending perpendicularly from a center of one side. Shaped split pin 4710 engages within shaped recess 4712 such that top portion 4702 and base 4706 are rotatably coupled together. Base 4706 may have an outer knurled (or similar) surface 4708 to facilitate gripping thereof. In certain embodiments, a lower face of base 4706 may include a magnet 4718 that magnetically retains a large marking disk 4720 against base 4706. Large marking disk 4720 may be similar to large marking disc 3708, and may include a smaller marking disc (not shown) that is similar to smaller marking disc 3806.

Figure 48:
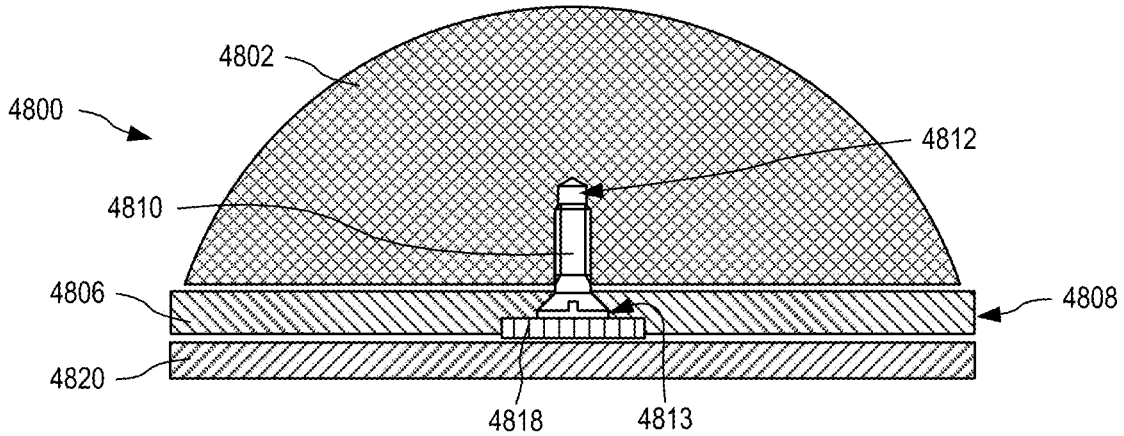

FIG. 48 is a cross-section of a 3D golf ball marker 4800 that is similar to 3D golf ball marker 104(16) of FIGS. 37-39, but includes a sixth pivot mechanism that allows rotation of a top portion 4802, which may be semi-spherical in shape with an alignment marking on an outer surface, relative to a base 4806. Top portion 4802 has a hole 4812 formed through a lower surface to receive a screw/bolt 4810. Base 4806 has a hole 4813, smaller than a head of screw/bolt 4810, through a center of base 4806, which is for example a flat disc. As shown in FIG. 48, hole 4813 is countersunk such that screw/bolt 4810 may be recessed. Screw/bolt 4810 engages within top portion 4802 to rotatably retain base 4806 with top portion 4802. Base 4806 may have an outer knurled (or similar) surface 4808 to facilitate gripping thereof.

In certain embodiments, a lower face of base 4806 may include a magnet 4818 that magnetically retains a large marking disk 4820 against base 4806. Advantageously, magnet 4818 may cover the head of screw/bolt 4810 as shown. Large marking disk 4820 may be similar to large marking disc 3708, and may include a smaller marking disc (not shown) that is similar to smaller marking disc 3806. The size and shape of one or more of screw/bolt 4810, hole 4812, and hole 4813 may be configured such that screw/bolt 4810 does not prevent rotation of top portion 4802 relative to base 4806 when screw/bolt 4810 is installed.

Figure 49:
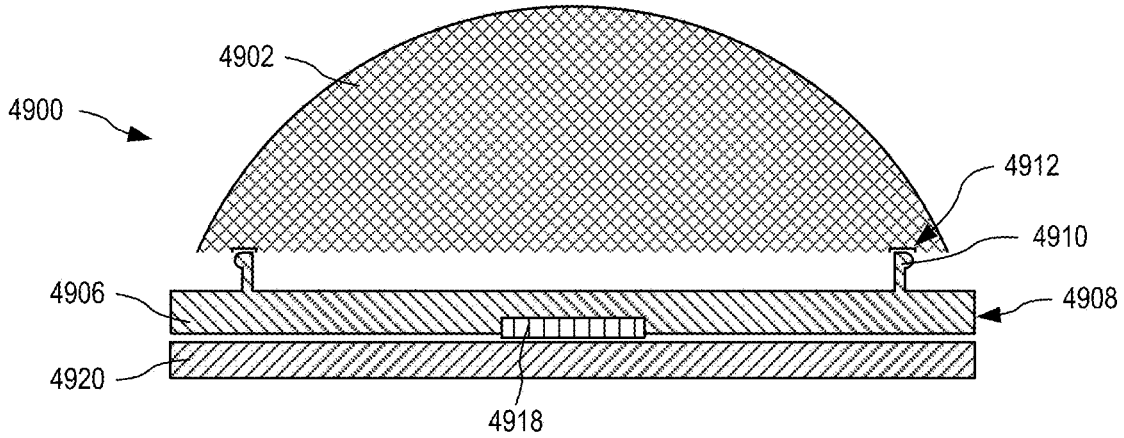

FIG. 49 is a cross-section of a 3D golf ball marker 4900 that is similar to 3D golf ball marker 104(16) of FIGS. 37-39, but includes a seventh pivot mechanism that allows rotation of a top portion 4902, which may be semi-spherical in shape with an alignment marking on an outer surface, relative to a base 4906. Top portion 4902 may have a channel 4912 formed in a lower surface near a perimeter. Base 4906 may have a corresponding protrusion 4910 on an upper surface and around a perimeter, where protrusion 4910 may engage with channel 4912 to rotatably couple top portion 4902 and base 4906 together. In certain embodiments, protrusion 4910 is formed in segments that extend from, and are positioned around the perimeter of, the top surface of base 4906 to couple with channel 4910. In certain embodiments, protrusion 4910 is formed of a plurality of pins that each extend from, and are positioned around the perimeter of, the top surface of base 4906 to couple with channel 4910. Channel 4912 and protrusion 4910 may be shaped such that top portion 4902 and base 4906 may be pressed together to engage protrusion 4910 within channel 4912, and such that top portion 4902 may be easily rotated relative to base 4906. Base 4906 may have an outer knurled (or similar) surface 4908 to facilitate gripping thereof.

In certain embodiments, a lower face of base 4906 may include a magnet 4918 that magnetically retains a large marking disk 4920 against base 4906. Large marking disk 4920 may be similar to large marking disc 3708, and may include a smaller marking disc (not shown) that is similar to smaller marking disc 3806.

The following example of operation uses 3D golf ball marker 4100 of FIGS. 41-43, however, each of 3D golf ball markers 4400, 4500, 4600, 4700, 4800 and 4900, of FIGS. 44, 45, 46, 47, 48, and 49, respectively, may be used similarly. A golfer may mark their golf ball using three-dimensional golf ball marker 4100, lift their ball from the green, and then rotate outer shell 4102 and alignment marking 4104 to assist in lining up their putt without moving base 4106. Further, the golfer may hold a knurled surface 4108 of base 4106 to ensure 3D golf ball marker 4100 does not accidentally move when top portion 4802 is rotated to adjust the alignment marking on top portion 4802.

As appreciated, the swivel mechanism described in association with FIGS. 43-49 may be incorporated with any of 3D golf ball markers 104, 304, 3404, without departing from the scope of the embodiments described herein. Similarly, certain features of 3D golf ball markers 104, 304, 3404 may be included with any of 3D golf ball markers 4100, 4400, 4500, 4600, 4700, 4800, and 4900 without departing from the scope of the embodiments described herein.

Spectator Enhanced Experience

Many golf tournaments and televised events, such as the PGA Tour events, British Open events, match play events, amateur events, club events, and so on, are attended by spectators, many of whom wish to follow their favorite golfers.

In one aspect of the embodiments disclosed herein includes the realization that navigating a golf course where play is in progress is often difficult and finding a particular golfer on the course is not straight forward. Advantageously, by using a tracking three-dimensional golf ball marker and spectator enhancement system, a spectator may learn the current golf hole of a golfer, or whether the golfer is in the clubhouse, on the practice ground, or elsewhere at the course facilities.

One aspect of the embodiments disclosed herein includes the realization that information provided to spectators at the golf course is often limited to score boards, so spectators often try to view live action as much as possible. Advantageously, through use of the tracking three-dimensional golf ball marker and spectator enhancement system, the spectator may interactively receive an enhanced topology view of a green showing where the golfer's golf ball is and the difficulty of the putt from the perspective of the golfer.

Figure 34:
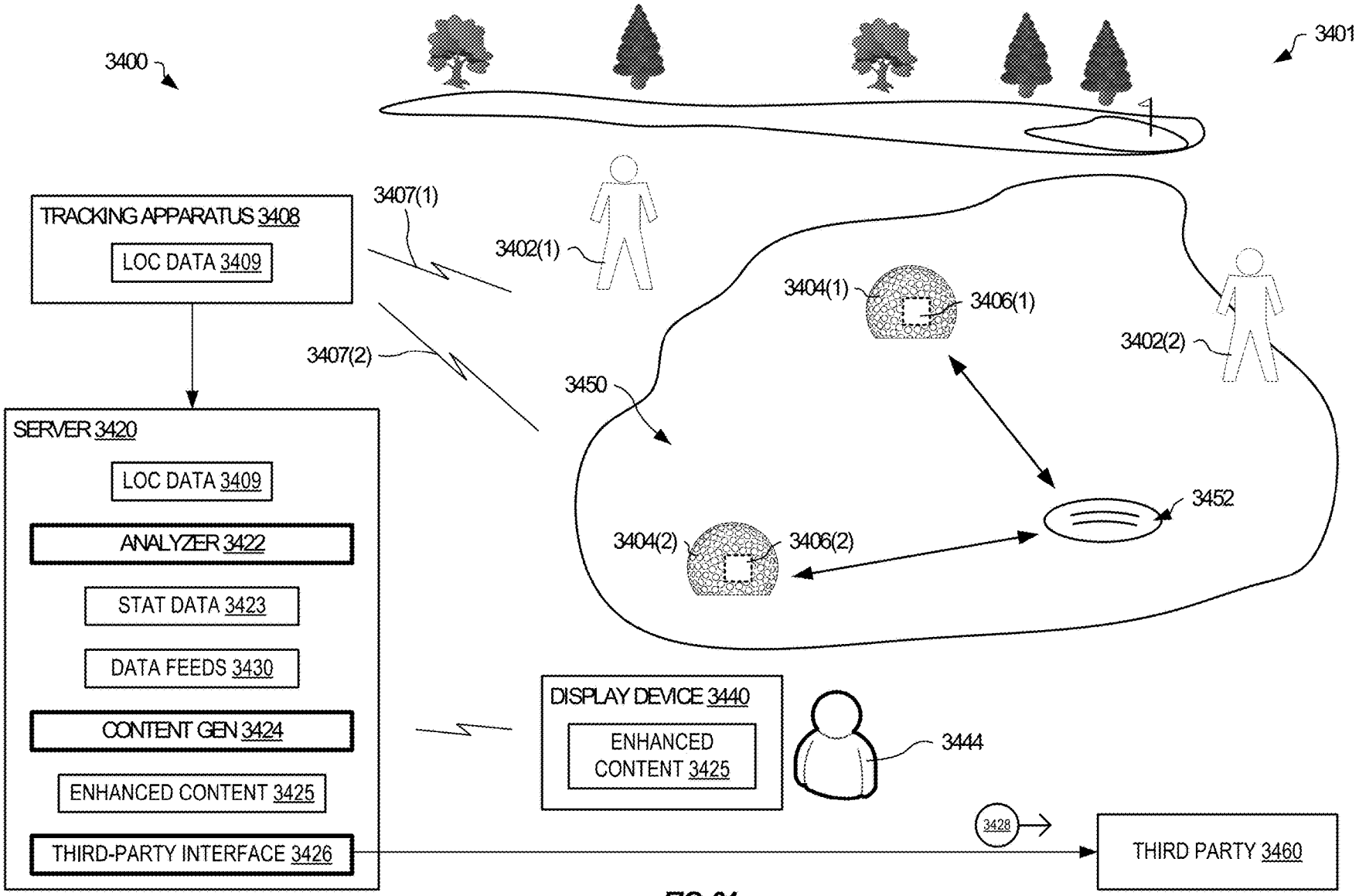
FIG. 34 shows one example system for enhancing experience of a golf spectator, in an embodiment.
Figure 35:
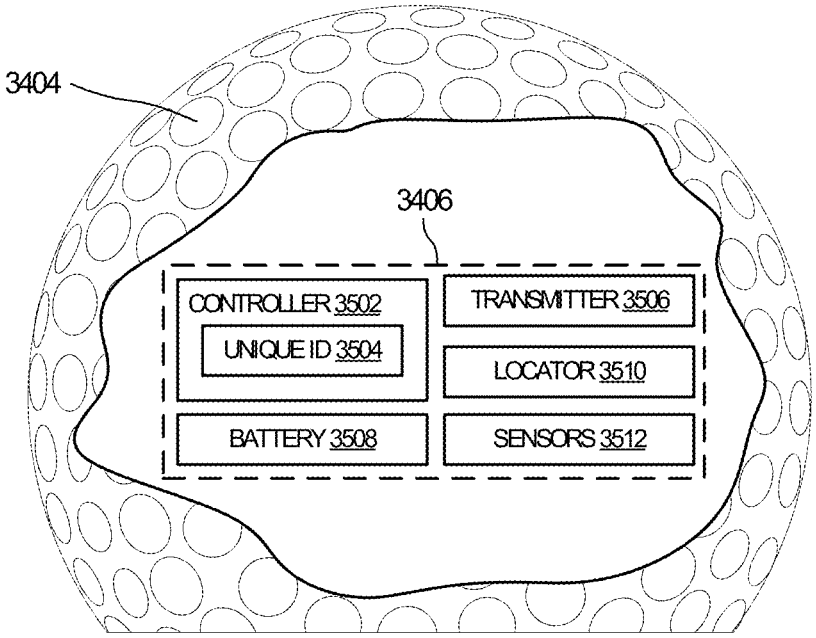
FIG. 35 is a functional diagram illustrating example components of a tracking circuit of the three-dimensional golf ball marker of FIG. 34.
Figure 36:
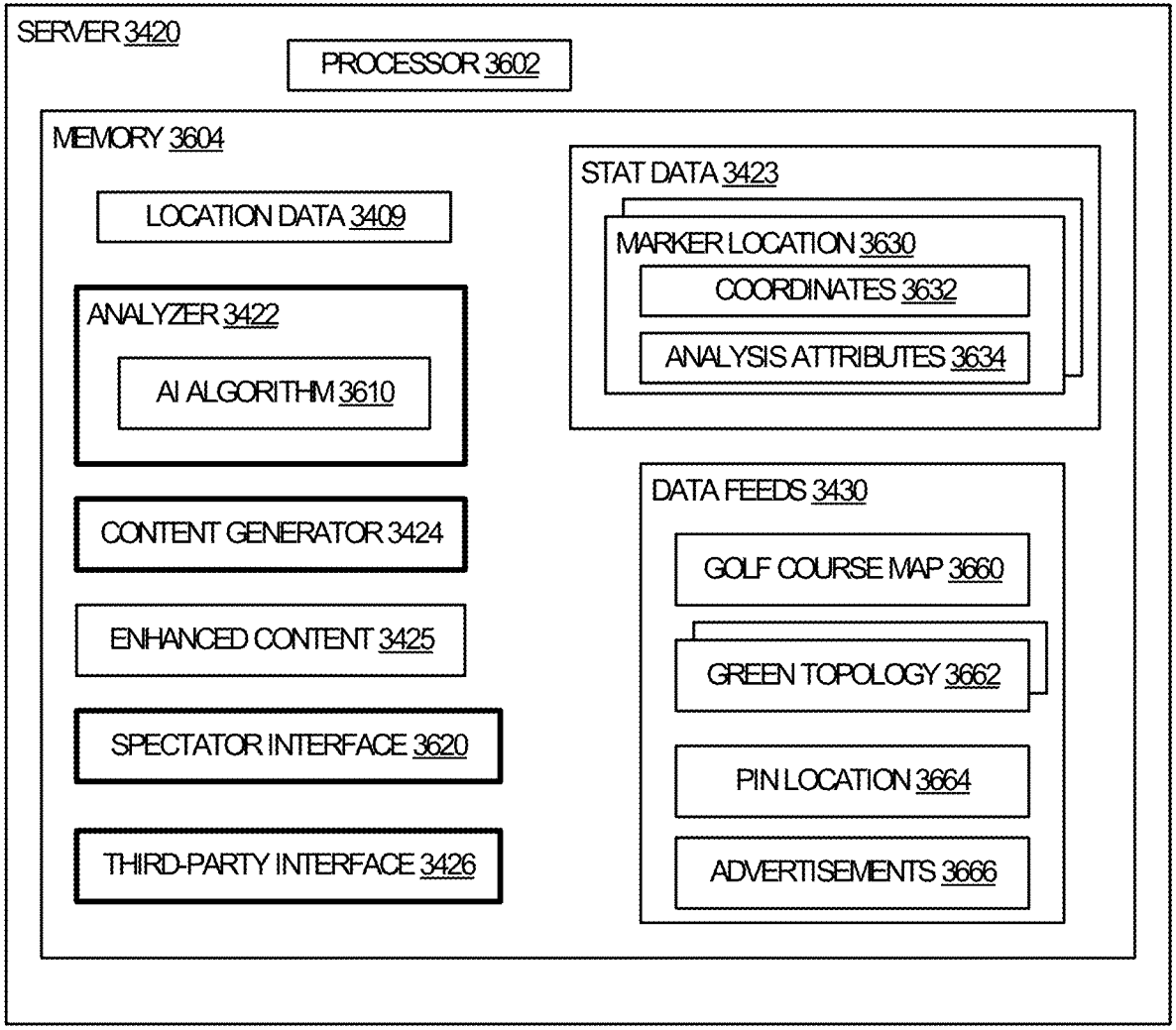
FIG. 36 is a functional diagram showing the server of FIG. 34 in further example detail.

FIG. 34 shows one example system 3400 for enhancing experience of a golf spectator 3444. FIG. 35 is a functional diagram illustrating example components of a tracking circuit 3406 of three-dimensional golf ball marker 3404 of FIG. 34. FIG. 36 is a functional diagram showing server 3420 of FIG. 34 in further example detail. FIGS. 34-36 are best viewed together with the following description. In the following description, functionality of a single three-dimensional golf ball marker 3404 is described. However, system 3400 may concurrently track multiple three-dimensional golf ball markers 3404(1) and 3404(2). Although shown to have a shape similar to three-dimensional golf ball markers 304 of FIG. 3, three-dimensional golf ball markers 3404 may be shaped similar to three-dimensional golf ball markers 104 of FIGS. 1, 2, and 4-31, or may be alternatively shaped without departing from the scope hereof.

During a game of golf, such as a golf tournament for example, an entity (e.g., the tournament organizer, golf course owner, television production studio, and/or an advertiser) may deploy system 3400 at a golf course 3401 (e.g., including facilities such as practice ground, clubhouse, and so on) to provide an enhanced experience for golf spectator 3444. Golfers 3402(1) and 3402(2) may respectively carry and use three-dimensional golf ball markers 3404(1) and 3404(2) that may be tracked by a tracking apparatus 3408. Accordingly, tracking apparatus 3408 may periodically (or aperiodically) determine location data 3409 of each three-dimensional golf ball marker 3404 at golf course 3401. Tracking apparatus 3408 provides the location data 3409 to server 3420, where an analyzer 3422, implementing one or more artificial intelligence tracking and data analysis algorithms, processes the location data 3409 to generate statistical data 3423 as golfers 3402 play golf course 3401. Server 3420 may also include a content generator 3424 that enhances conventional data feeds 3430 with statistical data 3423 to generate enhanced content 3425 for distribution to a display device 3440 of spectator 3444.

Enhanced content 3425 may include a current location of golfer 3402(1) on golf course 3401 that may allow spectator 3444 to position themselves to view upcoming play of golfer 3402(1). Enhanced content 3425 may also include topographical views of a putting green 3450 showing a current ball position and putting line of golfer 3402(1) and optionally of golfer 3402(2) also. Enhanced content 3425 may also show positions from where other golfers have previously putted.

Although tracking of golf balls is known for training purposes, such tracking is performed optically and restricted to an area significantly smaller than a golf course, such as a practice area and/or driving range. Such tracking technology if difficult and/or expensive to implement on an entire golf course.

In certain embodiments, each three-dimensional golf ball marker 3404(1) and 3404(2) may be configured with tracking circuits 3406(1) and 3406(2), respectively. Since the three-dimensional golf ball marker 3404 is not subjected to the same rigorous standards and punishment as a golf ball, tracking circuit 3406 may be configured to allow tracking from greater distances, as compared to RFID tracking solutions. Also, since tracking circuit 3406 is not used to track trajectory of a golf ball in real time, the locating frequency of tracking circuit 3406 may be reduced, thereby improving battery life.

Tracking apparatus 3408 may have receivers distributed over golf course 3401 to receive wireless signals 3407 from tracking circuits 3406. Locating may be implemented in any one of many different ways; triangulation of a radio signal transmitted by tracking circuit 3406, decoding of the radio signal where it includes self-determined location data, a combination of these two methods, optical tracking, and so on. In certain embodiments, tracking apparatus 3408 includes a plurality of receivers, distributed over golf course 3401, that implement a Bluetooth protocol for communicating with tracking circuits 3406, where each tracking circuit 3406 uses geo-location to determine and reports its location to tracking apparatus 3408. As shown in FIG. 35, tracking circuit 3406 includes a controller 3502 configured with a unique identifier 3504, a transmitter 3506 and a battery 3508. Other embodiments of tracking circuit 3406 may further include one or both of a locator 3510 and a plurality of sensors 3512, as described in further detail below. Locator 3510 is for example a global navigation satellite system (GNSS) based receiver (geo-locator) that determines its locations from radios signals received from satellites.

Controller 3502 is for example a microcontroller that includes a processor and memory for storing unique identifier 3504 and a plurality of machine readable instructions that, when executed by the processor, instruct controller 3502 to control transmitter 3506 to periodically (or aperiodically) transmit a wireless signal 3407 indicative of a location of three-dimensional golf ball marker 3404. Transmitter 3506 includes an antenna and is configured to transmit a low powered wireless signal at a particular frequency and using a particular protocol (e.g., amplitude modulated, frequency modulated, and so on). When not transmitting, transmitter 3506 may revert to a low powered state to reduce power consumption.

As shown in FIG. 36, server 3420 is a computer that includes a processor 3602 communicatively coupled with memory 3604 that stores analyzer 3422, content generator 3424 and a spectator interface 3620. Analyzer 3422, content generator 3424 and spectator interface 3620 may be implemented as machine readable instructions that, when executed by processor 3602, implement functionality of server 3420 as described herein. Analyzer 3422 is shown with an AI algorithm 3610 that processes location data 3409 to determine and store statistical data 3423 that may include a marker location 3630 that has coordinates 3632 and analysis attributes 3634. Coordinates 3632 defines the location of three-dimensional golf ball marker 3404 on golf course 3401 and may define a geographic location or relative location (e.g., to a reference point of golf course 3401). Analysis attributes 3634 may include one or more of an orientation (e.g., as determined by one or more sensors 3512 of tracking circuit 3406) of three-dimensional golf ball marker 3404, an indicator as to whether the three-dimensional golf ball marker 3404 is marking a golf ball (e.g., when the coordinates 3632 are located within an area of putting green 3450 and have not moved for a predefined period), and so on. In one example of operation, when AI algorithm 3610 determines that three-dimensional golf ball marker 3404 is marking a position of a golf ball on putting green 3450, analyzer 3422 may use the determined location of three-dimensional golf ball marker 3404 as the location of the corresponding golf ball, and determine a distance of the golf ball from the hole 3452.

Data feeds 3430 may include one or more of a golf course map 3660, green topologies 3662, pin locations 3664, FED Ex points, career earnings, standings, money list, scores, playing profile, personal information, and so on. Content generator 3424 uses statistical data 3423 and data feeds 3430 to generate enhanced content 3425 when requested by spectator 3444.

In certain embodiments, where display device 3440 is a smartphone or tablet, display device 3440 may send a geographic location (e.g., as determined by GPS geo-locator within the smartphone or tablet) to spectator interface 3620. In other embodiments, tracking apparatus 3408 may determine location of display device 3440 using triangulation, geo-location, or other location techniques. Accordingly, spectator interface 3620 may invoke content generator 3424 to generate enhanced content 3425 corresponding to the location of display device 3440. For example, where content generator 3424 determines that display device 3440 is near putting green 3450, content generator 3424 generates enhanced content 3425 corresponding to putting green 3450 and golfers 3402 playing on that green. In this example, enhanced content 3425 may show a topography of putting green 3450, locations (based upon determined locations of three-dimensional golf ball markers 3404) of golf balls of golfers 3402 and a location of the hole (or cup) 3452 (e.g., based upon pin location 3664) on the topology such that spectator 3444 may see the difficulty of the putts being faced by golfers 3402. Spectator 3444 may, for example, manipulate the enhanced content 3425 on display device 3440 to fully assimilate the difficulty of the putt.

Spectator interface 3620 may require spectator 3444 and/or display device 3440 to log into server 3420 for an associated cost, payable to the managing entity. In another example, the managing entity may rent, at an entrance of golf course 3401 for example, display device 3440 to spectator 3444 for an associated cost, such that spectator 3444 may use the display device 3440 while at the golf course 3401.

In certain embodiments, spectator interface 3620 is a web site that allows spectator 3444 to request information from server 3420. For example, spectator 3444 may request enhanced content 3425 of a particular golfer 3402 (e.g., a favorite golfer, a leader, and so on), wherein content generator 3424 generates enhanced content 3425 corresponding to the identified golfer 3402. In another example, spectator 3444 may request enhanced content 3425 for hole three, even when the spectator 3444 is watching play on hole seven.

Display device 3440 may display other golfing information (e.g., a live scoreboard, statistical data, predictions, etc.) for play at golf course 3401, and may also be used to provide information of other facilities (e.g., restaurants, restrooms, first-aid, and so on) at golf course 3401. In certain embodiments, content generator 3424 may include one or more advertisements 3666 and thereby earn revenue for the managing entity through advertising revenue.

Third-Party Interface

Server 3420 may also include a third-party interface 3426 configured to send location data 3409 and/or enhanced content 3425 to a third-party 3460. For example, where third-party 3460 is a betting agency (e.g., a sports betting company, such as Paddy Power, Fan Duel, Draft King, Bet Fair, Bet Victor, William Hill), third-party interface 3426 may process one or more of location data 3409, statistical data 3423, data feeds 3430, and/or enhanced content 3425 to generate a third-party data feed 3428 that is communicated in real-time to third-party 3460. Server 3420 may generate several different third-party data feeds 3428 for several different third-parties, each third-party data feed 3428 providing the corresponding third-party 3460 with information that they use. For example, third-party data feed 3428 may include location data 3409 with an identity of golfer 3402 corresponding to the tracked three-dimensional golf ball marker 3404. In another example, third-party data feed 3428 may include location data 3409 with an identity of golfer 3402 corresponding to the tracked three-dimensional golf ball marker 3404 and a status indicating whether three-dimensional golf ball marker 3404 is marking a golf ball on putting green 3450, a distance of the golf ball from the hole 3452 and a statistical probability, based on other putts from a similar location, that the putt will be made.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. A system for marking a position of a golf ball on a putting green, comprising:
- a three-dimensional golf-ball marker having a housing having:
  - a spherical outer surface defining a spherical cap shape with a bottom surface defined at a cap plane of the spherical cap shape, the bottom surface having a recess formed therein, the spherical cap shape having a spherical diameter between one and two inches, and
  - an alignment mark formed on the spherical outer surface of the housing;
- a removable marking disc, the removable marking disc having a first diameter smaller than a second diameter of the recess cap plane; and,
- a magnet configured with the housing and positioned within the recess to magnetically retain the removable marking disc within the recess.

2. The system of claim 1, the alignment mark being along a vertical plane through and perpendicular to the cap plane, the vertical plane being at a center of the cap plane.

3. The system of claim 1, the spherical outer surface having a texture selected from the group consisting of golf ball like dimples, smooth, grooved, ridged, rubbery, and polished.

4. The system of claim 1, the housing having a height greater than a radius of the housing.

5. The system of claim 1, the housing having a height less than a radius of the housing.

6. The system of claim 1, the removable marking disc comprising a second alignment mark formed on at least one side of the removable marking disc.

7. The system of claim 1, the magnet configured with the housing to retain the removable marking disc adjacent the bottom surface.

8. The three dimensional golf ball marker system of claim 1, the recess comprising a slot having a semi-circular lip with an internal diameter less than the first diameter of the removable marking disc and an open end at an edge of the housing, wherein the removable marking disc frictionally slides into the slot and is retained by the semi-circular lip.

9. The three dimensional golf ball marker system of claim 1, the removable marking disc comprising a spike protruding perpendicularly from one side of the removable marking disc, wherein the housing comprises a retaining mechanism for removably coupling with the spike to retain the removable marking disc adjacent the bottom surface.

10. The system of claim 1, the housing comprising a base, a coupling mechanism, and a top portion forming the spherical outer surface, wherein coupling mechanism allows the top portion to rotate with respect to the base.

11. The system of claim 10, the coupling mechanism comprising one of (a) a magnet, (b) a ball bearing race, (c) a shaped split pin and shaped recess, (d) a screw/bolt, and (e) a shaped channel and shaped protrusion.

12. The system of claim 1, further comprising:
- a wireless locating device for determining a location of the three-dimensional golf ball marker; and
- a wireless transmitter for transmitting the location of the three-dimensional golf ball marker to a tracking apparatus.

13. The system of claim 12, further comprising at least one sensor for sensing a condition at the location, wherein the wireless transmitter transmits the condition to the tracking apparatus.

14. The system of claim 12, the wireless locating device comprising a global positioning receiver for determining a geographic location of the three-dimensional golf ball marker.

15. The system of claim 12, the wireless transmitter periodically transmitting an identifying wireless signal for triangulation by the tracking apparatus.

* * * * *